US005320153A

United States Patent [19]

Knerr

[11] Patent Number: 5,320,153

[45] Date of Patent: Jun. 14, 1994

[54] METHOD AND APPARATUS FOR AROUND THE CURVE SAWING

[75] Inventor: Michael P. Knerr, Ridgefield, Wash.

[73] Assignee: U.S. Natural Resources, Inc., Vancouver, Wash.

[21] Appl. No.: 949,124

[22] Filed: Sep. 21, 1992

Related U.S. Application Data

[63] Continuation-in-part of Ser. No. 783,009, Oct. 28, 1991, Pat. No. 5,148,847.

[51] Int. Cl.[5] ..... B27B 1/00; B27B 31/00

[52] U.S. Cl. ..... 144/357; 83/75.5; 83/367; 144/246 D; 144/246 F; 144/378; 144/3 R; 198/782; 364/474.09

[58] Field of Search ..... 83/74, 75.5, 367; 144/3 R, 39, 41, 246 R, 246 D, 246 F, 356, 357, 377, 378; 198/624, 631, 841, 782; 364/468, 474.09, 560

[56] References Cited

U.S. PATENT DOCUMENTS 4,373,563 2/1983 Kenyon .
4,416,312 11/1983 Ostberg .
4,440,203 4/1984 Ostberg ..... 144/39
4,458,567 7/1984 Tuomaala .
4,485,861 12/1984 Nilsson .
4,548,247 10/1985 Eklund .
4,572,256 2/1986 Rautio .
4,633,924 1/1987 Hasenwinkle et al. .
4,653,560 3/1987 Wislocker et al. .
4,690,188 9/1987 Hasenwinkle .
4,774,988 10/1988 Washburn et al. .
4,881,584 11/1989 Wislocker et al. .
4,893,663 1/1990 Ely .
4,907,632 3/1990 Reuter .
4,947,909 8/1990 Stroud .

FOREIGN PATENT DOCUMENTS 33098 12/1908 Sweden .

*Primary Examiner*—W. Donald Bray
*Attorney, Agent, or Firm*—Keith A. Cushing

[57] ABSTRACT

A method and apparatus for around the curve sawing is shown and described wherein a group of roller assemblies are positionable along a selected semicircular path having a point of tangency relative to lines of cut provided by an assembly of cutting blades whereby each roller assembly provides a transport path normal to the axes of rotation for each roller assembly and tangent to the selected semicircular path. Upon actuation of the roller assemblies, as positioned along the selected semicircular path, the wood product, as captured between rollers of the roller assemblies, moves along the selected semicircular path and into the cutting device for cutting along concentric lines of cut. The method and apparatus is particularly well suited for use with tree species having irregularly shaped protrusions and formations deviating from an idealized curved centerline of the log or cant.

20 Claims, 17 Drawing Sheets

METHOD AND APPARATUS FOR AROUND THE CURVE SAWING

RELATED APPLICATION

The present application is a continuation-in-part of U.S. patent application Ser. No. 07/783,009, entitled METHOD AND APPARATUS FOR AROUND THE CURVE SAWING filed Oct. 28, 1991 by applicant and assignee herein and allowed for issuance into U.S. Pat. No. 5,148,847 on Sep. 22, 1992.

BACKGROUND OF THE INVENTION

The present invention relates generally to wood processing, and particularly to a feed mechanism and cutting arrangement for around the curve sawing.

As the use of second growth timber in lumber processing operations continues and the increased use of certain species of irregularly formed logs continues, the need grows for improved methods of recovery in the process of converting these raw materials into suitable lumber products. One area in which improved recovery may be obtained is by taking into account the sweep or curvature of the log in cutting the log into wood products. More particularly, if a curved or sweepy log is cut along its curve, then more wood product may be recovered from the log than would be possible in a more conventional process using straight cuts.

There are a number of patents which address the issue of around the curve sawing in order to improve recovery from sweepy logs or cants. In one approach, a curved linebar is used to guide a workpiece along a curved path and into a sawing device. The curved linebar is adjustable to match generally the curvature of the workpiece in the hope that by placing the exterior surface of the workpiece against the curved linebar and moving it along the linebar, it will move along an appropriate path into the cutting device to accomplish the desired around the curve cutting.

The prior method of improved product recovery by means of a curved linebar has proven useful in certain situations. More particularly, the use of a curved linebar is most efficient only where the curvature of the workpiece is generally well behaved. Most species of trees in the western portion of the United States have what will be referred to herein as "well behaved" curves. In particular, well behaved cants or logs have an exterior surface that lies substantially concentric to its overall curvature. In such cases, this exterior curved surface may be placed against a curved linebar with the linebar adjusted to provide a corresponding curvature and the desired improved recovery may be obtained.

Other species of trees, for example, Southern Yellow Pine, are not well behaved because of knot protrusions, swelled butts, S-crook, and sweep. Such tree species are not well suited for use with a curved linebar because the protrusions and irregularities of cants produced from these trees do not provide an exterior surface matching the general curvature of the cant and providing a suitable surface for placement against a curved linebar. The position of the cant against the linebar is critical with respect to the actual cut made. If a tapered cant has a large swelled butt, the main body of the cant in the butt area will be forced out away from the linebar while the other end of the cant will be located closer to the linebar. With such irregular positioning with respect to the curved linebar, the ideal first saw cut or opening face cannot be achieved and relatively lower lumber yields result. Thus, misalignment of the curvature of the cant relative to the curved linebar results in an inability to significantly improve recovery.

Swedish Patent No. 33,098 shows a sawing device having two feed roll assemblies, each with parallel upper and lower rollers for gripping a log therebetween. Each roll assembly can be pivoted so that the axes of rotation for each assembly lie at an angle and intersect at a point defining a curve along which the log is to travel in cutting the log. Each roll assembly is pivoted about a corresponding pivot point whereby the roll assembly axes of rotation may be selectively oriented in parallel relation or in relative angular relation for establishing a straight or a curved feed path. Because the rollers contact the crest of the log surface, the shape of the log itself when irregular or not well behaved will affect significantly the resulting curved feed path. Thus, for logs without well behaved curvature or irregular surfaces the resulting feed path is unpredictable and unacceptable in a high efficiency recovery system. The respective pivot points define a line parallel to a straight feed path of the cutting device. There appears to be no practical way to add additional roller assemblies in order to accommodate long work pieces. The disclosed method of pivoting roller assemblies to provide curved path feeding would permit relative angular positioning by pivoting of more than two roller assemblies to establish a common point of intersection for such roller assembly axes of rotation, but one end of each roller assembly remains fixed and in alignment with the other roller assemblies. This is believed to limit significantly the available curved feed paths for more than two roller assemblies. Furthermore, as the roller assemblies are pivoted to establish a curved feed path, the resulting curved feed path has no fixed relationship to the cutting device. In other words, each selected curved feed path is defined by the angular relation between the rollers with no portion of the feed path having a fixed position other than with reference to the roller assemblies which necessarily move to establish the curved feed path. This "floating" curved feed path would require, in a high efficiency recovery system, repositioning of the cutting device according to the position of each selected feed path.

Accordingly, it would be desirable to provide an around the curve sawing apparatus better adapted to handle, for example, irregularly shaped sweepy cants and allow for a large number of roller assemblies. The subject matter of the present invention provides such an apparatus and may be applied to improve recovery from irregularly shaped tree species.

SUMMARY OF THE INVENTION

In the first illustrated embodiment of the present invention, the two parallel faces of a sweepy two-sided cant are engaged in order to transport the cant along a series of roller assemblies. Each roller assembly includes a lower drive roller and an upper pinch roller. Each roller assembly is carried upon a sub-base which allows shifting of each roller assembly. The sweepy cant is positioned upon the series of roller assemblies with each roller assembly positioned in such manner that the axis of rotation for each roller is normal to the curvature of a desired semicircular feed path, typically corresponding to the curvature of the cant. In this manner an ideal curved centerline of the cant is identified and the roller assemblies are positioned relative thereto whereby each roller assembly axis of rotation lies substantially normal to the corresponding portion of the curved centerline. Upon actuation of the rollers, the cant moves along a semicircular path. By positioning a cutting device at a point along this semicircular travel path, the desired around the curved cutting is achieved.

In accordance with one aspect of the present invention, cant curvature is determined prior to mounting upon the roller assemblies in order to identify a curved cant centerline representative generally of cant curvature exclusive of anomalies such as knot protrusion and swelled butts and determining a curved cutting pattern.

The method of the present invention is further enhanced by use of prepositioning systems and automated scanning systems. Prepositioning allows orientation of a wood article relative to a selected curved feed line while a previous wood article is under process. Scanning systems are employed to develop a model representing the curvature of given wood article whereby the curved feed path for that wood article is selected as the function of the model.

In a second illustrated embodiment of the present invention, a laterally flexible or curvable drive chain is employed in combination with press rollers. Under this embodiment, the drive chain is coerced into a selected curved feed path, but always passes below the set of press rollers. Thus, once a wood article is suitably positioned upon the drive chain with the drive chain in a selected curvature, the press rollers may engage the wood article and the drive chain may propel forward along the selected curved feed path.

The subject matter of the present invention is particularly pointed out and distinctly claimed in the concluding portion of this specification. However, both the organization and method of operation of the invention, together with further advantages and objects thereof, may be best understood by reference to the following description taken with the accompanying drawings wherein like reference characters refer to like elements.

BRIEF DESCRIPTION OF THE DRAWINGS

For a better understanding of the invention, and to show how the same may be carried into effect, reference will now be made, by way of example, to the accompanying drawings in which.

DETAILED DESCRIPTION OF THE PREFERRED EMBODIMENT

As used herein, the term "two-sided cant" shall refer to a wood product having two parallel, planar sides. Such cants are formed from sweepy or curved logs by positioning the logs either "horns up" or "horns down" and opening or removing, e.g., by chipper, the outward side facing portions of the wood product. Because the chipper heads are parallel and the cant may be moved along a linear path through the chipper, the resulting open faces of the two-sided cant are parallel and planar. Also, the greatest curvature of the two-sided cant lies generally in a plane parallel to the open faces.

As used herein, the term "four-sided" cant as applied to sweepy cants shall refer to a wood product having a substantially rectangular cross-section as defined by two parallel, planar sides as in a two-sided cant and two curved sides which are generally concentric, but may or may not be also concentric to the general curvature of the log from which the cant was produced.

The term "curved centerline" shall refer to a semicircular line modeling generally an overall curvature of the cant and specifying a curved cutting pattern for processing the cant, but not necessarily corresponding to the actual curvature of the cant. Thus, the curved centerline is an idealized model of a curved cant characterized by cant length and deviation from a linear centerline, the deviation being referred to herein as chord height.

Given a cant length (C) and chord height (H), a radius of curvature (R) may be calculated. Consider the following table and formula:

| C | H | | R |
|---|---|---|---|
| 16' | 2" | => | 2305" |
| 16' | 3" | => | 1537¼" |
| 16' | 4" | => | 1154" |
| 20' | 2" | => | 3601" |
| 20' | 3" | => | 2401¼" |
| 20' | 4" | => | 1802" |

$R = ((C*12)^2 + 4H^2)/8H$

The first number C is a given cant length in feet, the second number H is a given chord height in inches and the third number R is derived as the corresponding radius of curvature in inches. For example, a 20 foot cant with a 2 inch chord height may be modeled by a curved centerline having a radius of curvature of 3601 inches. It may be appreciated that the cant length and chord height measurements are measurements easily obtained in an automated or semiautomated scanning process for characterizing or modeling the curved cants in terms of a single value, i.e., a radius of curvature.

Figure 1:
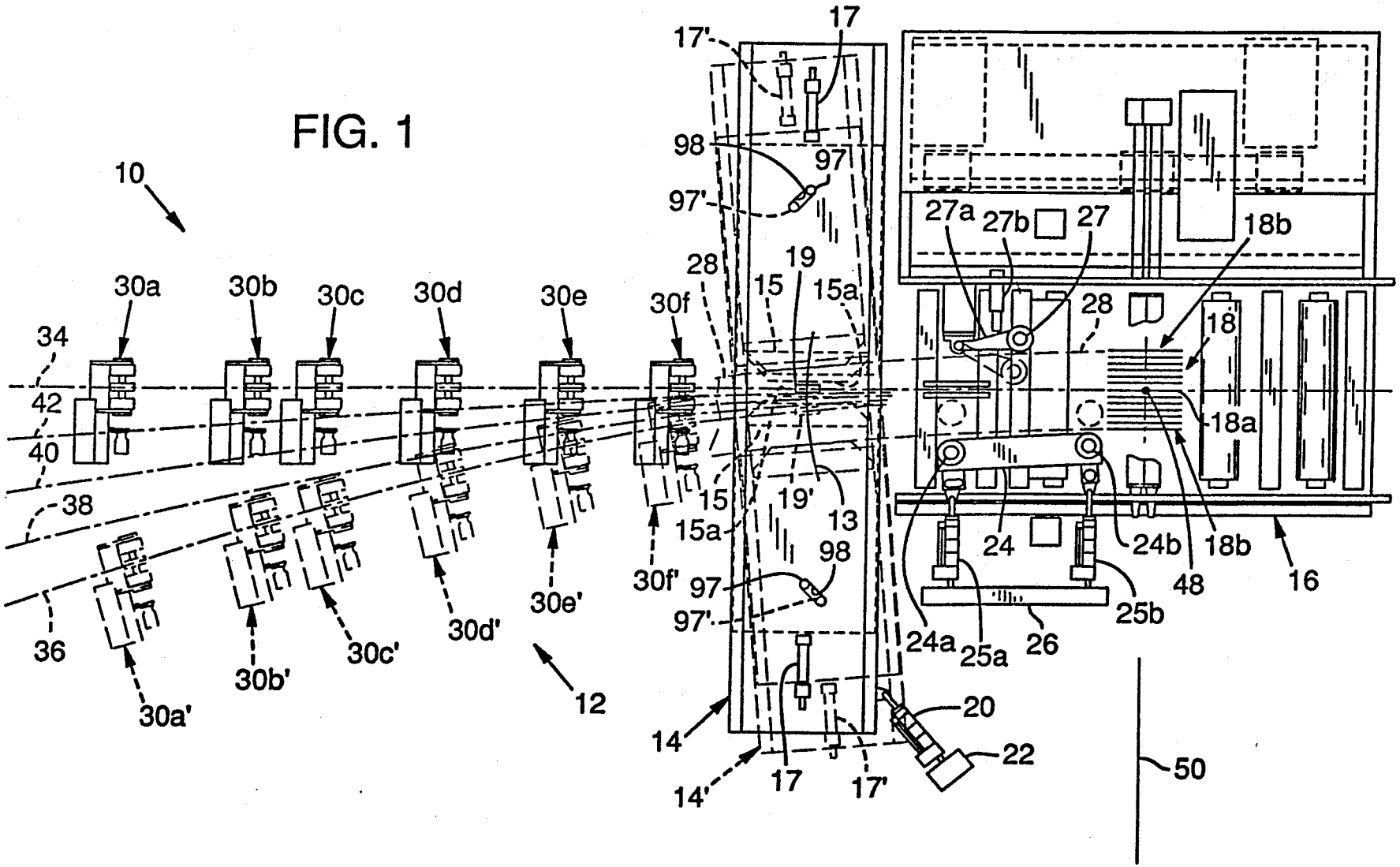
FIG. 1 is a layout view of an around the curve sawing apparatus including a infeed table adapted for cant transport along a selected curved path in accordance with the present invention.

FIG. 1 is a layout view of an arrangement for cutting curved cants. In FIG. 1, an around the curve cutting arrangement 10 includes an infeed system 12, a chipper station 14, and a rotary gang 16. The rotary gang 16 may be of generally conventional design and operation wherein blades 18, including in this case a center blade 18*a* and side blades 18*b*, receive a four-sided cant 28 and produce wood product according to the number and relative positioning of the blades 18.

The infeed system 12 is adapted, in accordance with the present invention, to manipulate two-sided cants in such manner that the transport of these cants into rotary gang 16 is along a selected semicircular path and produces lines of cut concentric to a selected curved centerline of the cant, typically concentric to the curved centerline of the cant. In this manner, improved recovery may be obtained because less wood product is wasted in producing the lumber. The resulting wood product is also curved, however, such curvature may be eliminated by subsequent stacking and drying steps.

Infeed system 12 of the illustrated embodiment comprises six shifting roller assemblies 30, individually numbered 30*a*–30*f*. Each roller assembly 30 is shown in two positions in FIG. 1, one position being indicated by reference numerals 30*a*–30*f* and in alignment with a center feed line 34 and with the axes or rotation for all roller assemblies in parallel relation, i.e. aligned for straight feed. The other illustrated position for each roller assembly is indicated by reference numerals 30*a*'–30*f* as positioned along a semicircle 36 and with the respective axes of rotation for each roller assembly normal to the semicircle 36. In this position along semicircle 36 a curved feed path is provided. Additional semicircles 38, 40 and 42 are shown intermediate of semicircle 36 and center feed line 34. The positioning of roller assemblies 30*a*– 30*f* along a selected semicircle may be infinitely variable positioning, i.e., selected positioning of roller assemblies 30*a*–30*f* may be with reference to an infinite number of semicircles. Thus, while specific semicircles 36–42 are shown in FIG. 1, these semicircles are provided merely as reference locations for illustrating the positioning of the roller assemblies 30*a*–30*f*. The specific semicircles 36–42 are associated with particular radii of curvature for 16 foot cants having 4, 3, 2, and 1 inch chord heights, respectively. Other cant lengths and chord heights would determine unique semicircles along which the roller assemblies 30*a*–30*f* can be positioned.

Semicircles 36–42 and center feed line 34 intersect at a fixed reference point 48 located within the blades 18. More particularly, reference point 48 coincides with the intersection of arbor centerline 50, in this case a mid-line between the two arbors, and center blade 18*a*. Thus, the center feed line 34 is tangent at the point 48 to each of semicircles 36–42. Other selected semicircles for positioning of roller assemblies 30*a*–30*f* would also have tangency with respect to center feed line 34 at the reference point 48.

By positioning the roller assemblies 30*a*–30*f* along a selected semicircular path, engaging a work piece by the roller assemblies, and actuating the roller assemblies 30, the work piece moves along the selected semicircular path. By positioning a curved cant in such manner that the selected curved centerline of the cant coincides with the semicircle along which the roller assemblies 30*a*–30*f* are positioned, and by providing tangency of the semicircular path with respect to center feed line 34 at the reference point 48, the rotary gang 16 cuts the curved cant into wood product along lines of cut concentric to the selected curved centerline.

Figure 2:
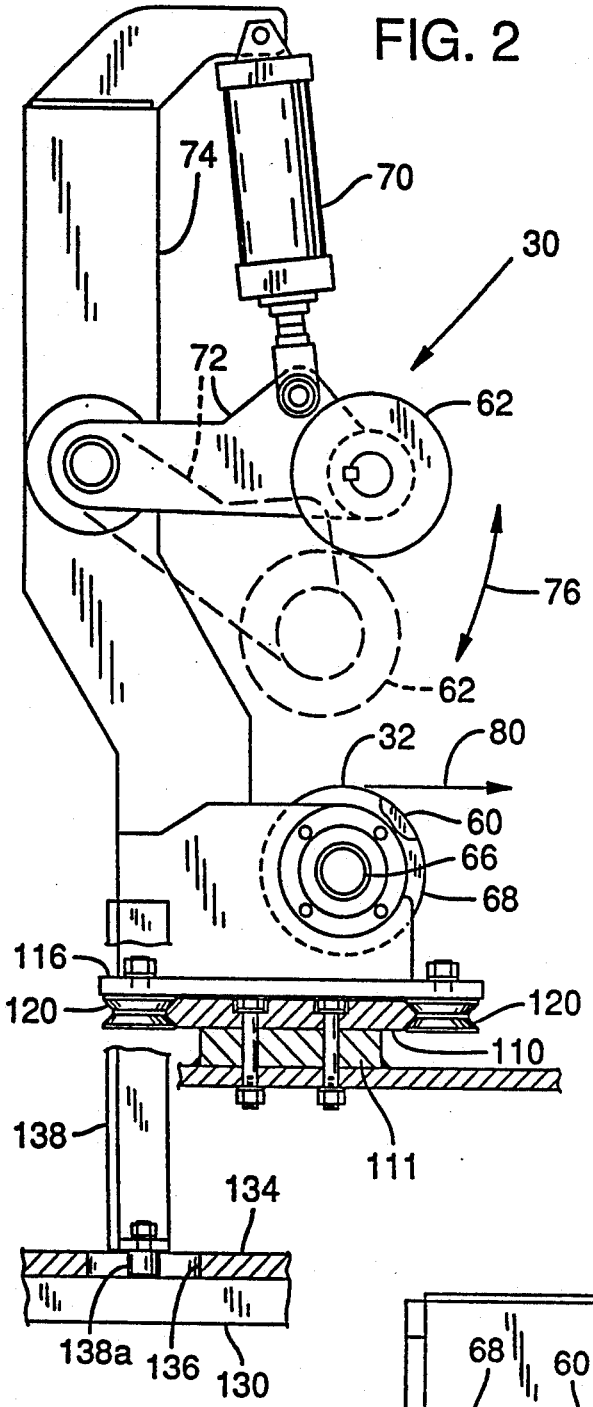
FIG. 2 is a side view of a roller assembly of the infeed table of FIG. 1.
Figure 4:
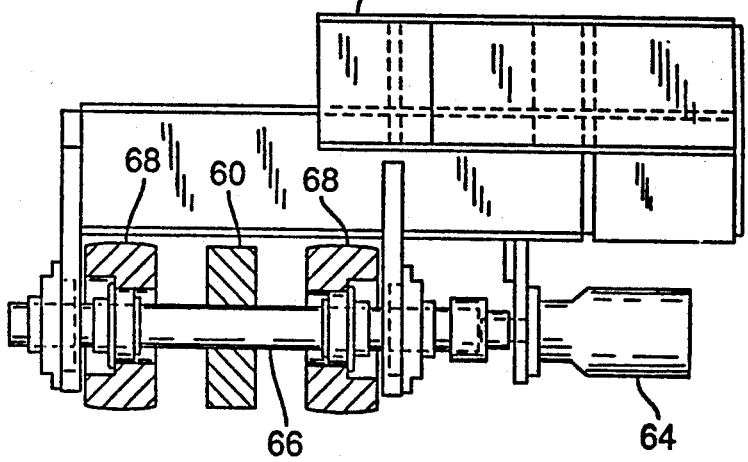
FIG. 4 is a top view of the roller assembly of FIG. 2.
Figure 3:
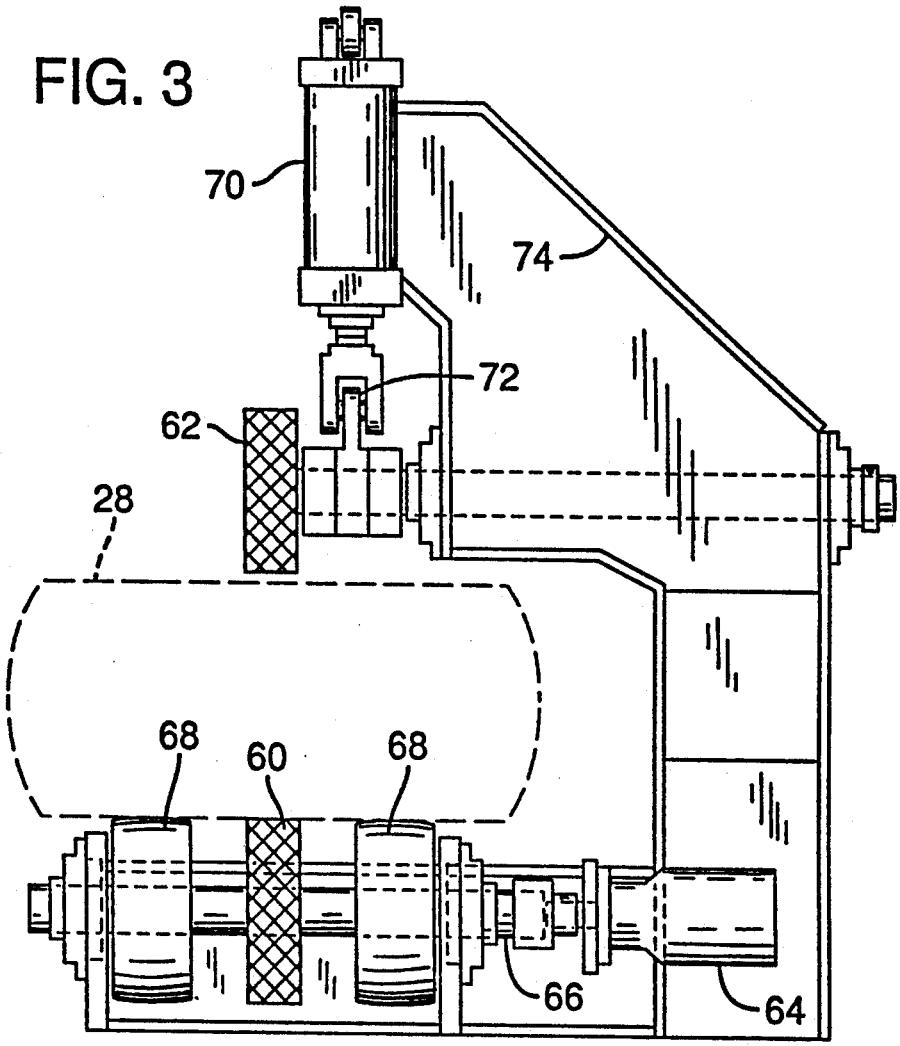
FIG. 3 is a front view of the roller assembly of FIG. 2.

The roller assemblies 30*a*–30*f* are identical in their basic structure and operation, with the exception of being positionable in the manner described above. More particularly, the positioning of each roller assembly 30 is unique as a function of the distance of the roller assembly 30 from the reference point 48 of rotary gang 16. FIGS. 2–4 represent, therefore, each of the roller assemblies 30*a*–30*f*.

In FIGS. 2–4, each roller assembly 30 includes a lower drive roller 60 and an upper pinch roller 62. A drive motor 64 engages a drive shaft 66 upon which drive roller 60 is fixedly mounted. Side idle rollers 68, one on each side of drive roller 60, mount rotatably with respect to drive shaft 66 and support the outer downward facing edges of the cant 28. Press roller 62 mounts rotatably as an idler roller, but is vertically positioned by means of pneumatic cylinder 70. More particularly, as shown in FIG. 2, press roller 62 mounts rotatably at the distal end of arm 72 which is pivotally mounted upon the frame 74 of roller assembly 30. Cylinder 70 couples arm 72 and frame 74 in such manner to move press roller 62 as indicated by the double headed arrow 76 in FIG. 2.

The axes of rotation for drive shaft 66 and press roller 62 are in parallel relation whereby actuation of cylinder 70 to move downward the press roller 62 against the upper surface of a two-sided cant 28 (FIG. 3), support of the cant at its lower surface by drive roller 60 and idle side rollers 68, and actuation of motor 64 urges the cant, with respect to a single assembly 30, along a transport path 80 (FIG. 2). Positioning of the rollers 30*a*–30*f* along a given semicircular path and actuating the motors 64, however, urges a work piece captured between rollers 60 and 62 generally along the given semicircular path. Each transport path 80 of each roller assembly 30 is positioned for tangency relative to a selected semicircular path, but the net effect is to move the cant along the selected semicircular path. The lateral dimension, i.e., width, of each of rollers 60 and 62 is narrow so as to minimize the differential radius between the inside edge and outside edge of the rollers 60 and 62 with respect to the selected semicircular path. This minimizes the effect of one side of the roller moving relatively faster than the other side of the roller with respect to a work piece moving along a semicircular path.

Returning to FIG. 1, chipper station 14 converts a two-sided cant into a four-sided cant just prior to the rotary gang 16. Chipper station 14 is positioned relative to the selected semicircular path along which the roller assemblies 30 are positioned. As explained more fully hereafter, the chipper station 14 may be shifted along a curved track path 13 whereby the curved open faces provided by chipper station 14 are substantially concentric to the selected curved feed path for the cant 28. Thus, hydraulic chipper positioning cylinder 20 couples chipper station 14 and stationary block 22 for selected shifting of chipper station 14 along the semicircular track path 13.

Chipper station 14 includes a pair of chipper heads 15. Positioning of each chipper head 15 will be referenced herein by a face 15*a* normal to the chipper head axis of rotation. The faces 15*a* of the chippers 15 are maintained in parallel face-to-face relation. Chipper station 14 includes hydraulic cylinders 17, each corresponding to one of chipper heads 15, for lateral positioning of the chipper heads 15 according to the desired width of the four-sided cant produced by chipper station 14. Chipper station 14 is shown in two positions, corresponding to the illustrated two positions of each roller assembly 30. More particularly, in one position designated by reference numeral 14, the faces 15*a* are parallel to center feed line 34. In the other position, designated by reference numeral 14', the faces 15*a* are substantially parallel to a line tangent to the semicircular path 36. By suitable actuation of cylinder 20, faces 15*a* may be positioned substantially parallel to the tangent of any selected semicircular path, e.g., semicircular paths 38–42 or any of an infinite number of selected semicircular paths. Chipper station 14 is further modified to include a roller assembly 19 including a lower support roller and an upper pinch roller similar to that of the roller assemblies 30, but without a drive feature. The axes of rotation for the rollers of roller assembly 19 are maintained normal to the faces 15*a* of chipper heads 15 whereby the feed path provided by the roller assembly 19 is maintained substantially tangent relative to the selected semicircular path for cant 28. The roller assembly 19 is shown in two positions in FIG. 1, with reference numeral 19 indicating positioning relative to center feed line 34 and the reference numeral 19' representing positioning relative to the semicircle 36.

A shifting linebar 24 is provided within the rotary gang 16 and carries at each end hydraulic powered drive rollers 24*a* and 24*b*. Each end of linebar 24 couples by way of corresponding hydraulic cylinders 25*a* and 25*b* to a stationary block 26. By suitably actuating cylinders 25*a* and 25*b*, the position of linebar 24 may be coordinated with the width of cant 28 as well as its selected semicircular feed path in order to allow drive rollers 24*a* and 24*b* to engage the outward facing sides of the cant 28 as it enters gang 16 without deflecting cant 28 from its curved feed path. A hydraulic powered drive-pinch roller 27 of rotary gang 16 is provided to maintain the cant 28 against the linebar 24. Pinch roller 27 mounts at the distal end of an arm 27*a* pivotally mounted within the rotary gang 16 and actuated by means of pneumatic cylinder 27*b*. The rotary gang 16 further includes additional drive rollers of conventional design for transporting the cant within rotary gang 16 and, in cooperation with drive rollers 24*a*, 24*b*, and 27 along a selected semicircular path toward the point 48.

The positioning of roller assemblies 30*a*–30*f*, chipper station 14 and linebar 24 may be accomplished generally as a function of a single parameter, i.e., a radius of curvature representing a curved centerline of a cant 28 to be processed. The cant width is further utilized as an input parameter for positioning the chipper heads 15 by operation of cylinders 17 and the further positioning of linebar 24 by operation of cylinders 25. Given the radius of curvature for the cant centerline, a circle having tangency with respect to the center feed line 34 at the reference point 48 and having a radius equal to the radius of curvature for the cant to be processed defines the selected semicircular path along which roller assemblies 30*a*–30*f* need be positioned, as well as the required positioning of chipper station 14 and linebar 24.

It may be appreciated that positioning of the roller assemblies 30*a*–30*f* and chipper station 14 would desirably be without practical constraint whereby, for example, the roller assembly carriages and chipper station 14 could be freely positioned in X and Y dimensions. The various transport paths for roller assemblies 30 and 19 could then be positioned by rotation of each roller assembly 30 carriage and chipper station 14 to be tangent to a selected semicircular path. For example, each roller assembly 30 could be positioned in X and Y dimensions with respect to a reference point 32 at the top center of drive roller 60. The roller assembly could then be rotated about the point 32 to make the transport path 80 tangent relative to the corresponding portion of the selected semicircular path. Similar positioning would apply to the roller assembly 19 of chipper station 14. Unfortunately, such a control system would require at least three actuators for each roller assembly and require a complex control and coordination system for independent roller assembly positioning. It is desirable, therefore, to provide a positioning scheme requiring less actuators and a simple control arrangement.

Figure 5A:
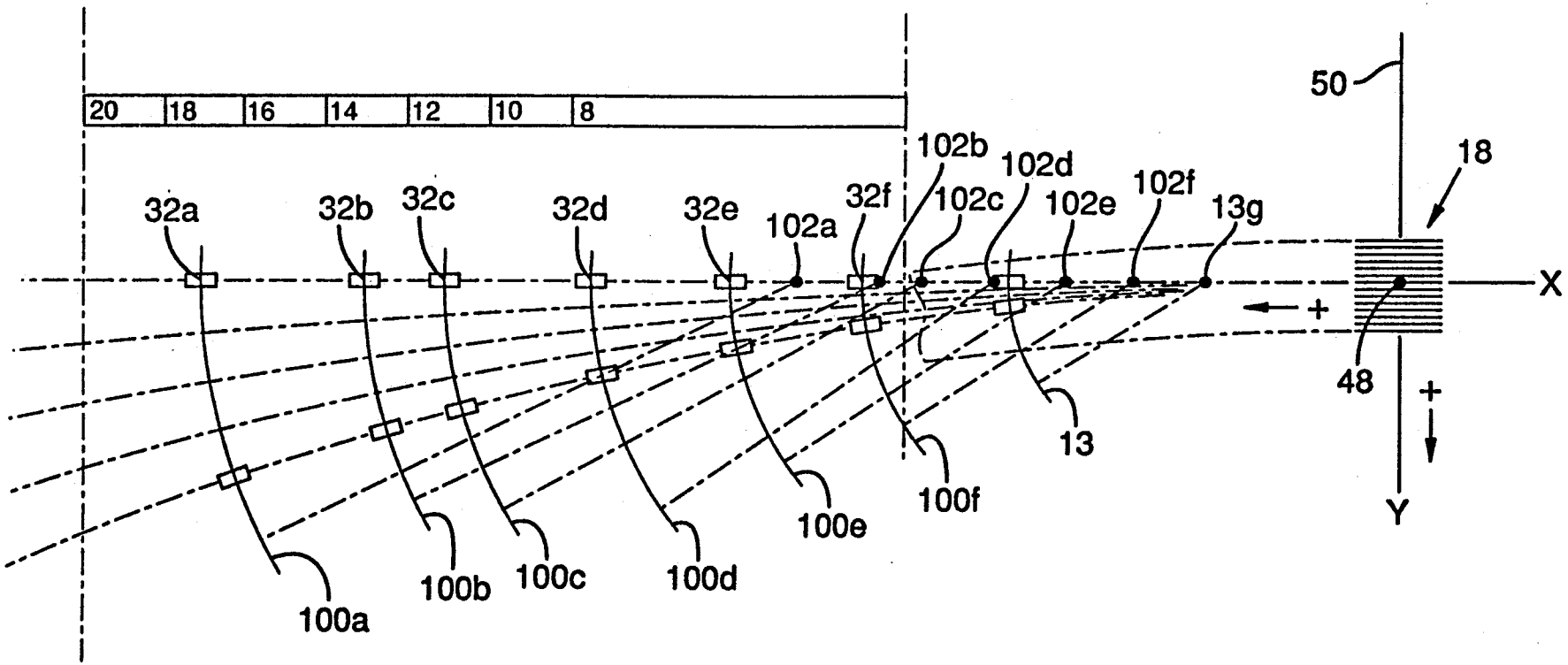
FIGS. 5A and 5B illustrate a travel model for positioning of the roller assemblies of the infeed table of FIG. 1 according to a preferred embodiment of the present invention.
Figure 5B:
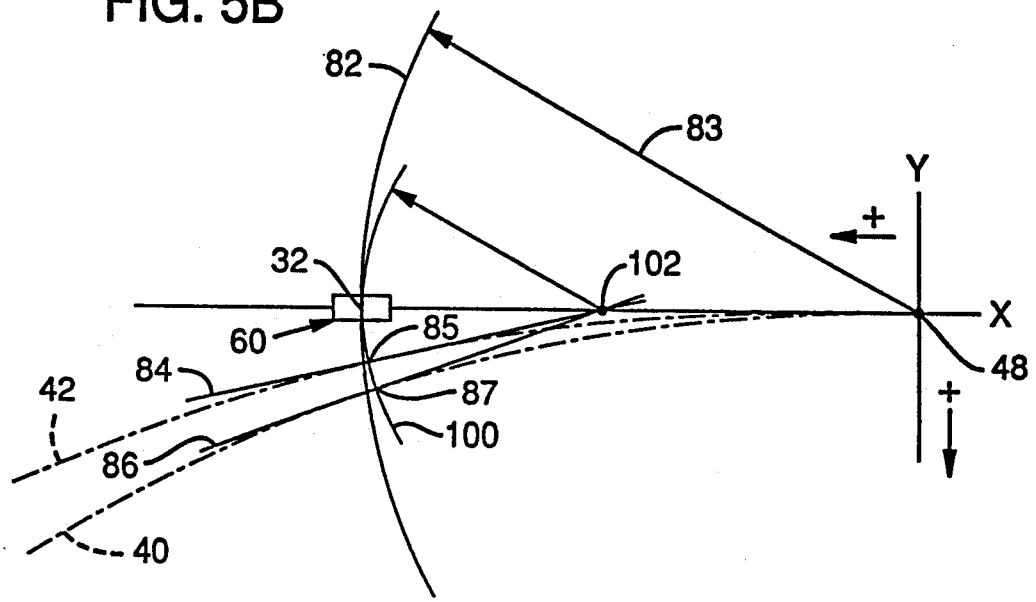

FIGS. 5A and 5B illustrate a roller assembly travel model which reduces significantly the number of actuators required to position the roller assemblies 30*a*–30*f* and chipper station 14 relative to a selected semicircular path. While some degree of error is introduced into the positioning of the roller assemblies 30*a*–30*f* and chipper station 14 according to this model, there is the advantage of requiring far fewer individual actuation devices to achieve substantially the same result. Generally, according to this travel model, the roller assemblies are moved along semicircular paths, it being understood that a semicircular path is more easily machined as compared to more complex curvatures. By providing a separate semicircular guide for movement of each roller assembly, a single actuator could satisfactorily move the roller assembly along its corresponding track path. It is, therefore, an objective of the illustrated travel model to reduce the complexity of the actuation mechanism as well as any control logic used to position the roller assemblies 30.

For each roller assembly 30 a semicircular track path 100 is defined. As previously mentioned, the chipper station 14 moves along its associated semicircular track path 13. Thus, track path 100*a* corresponds to roller assembly 30*a*, has a radius of curvature of 175.852 inches and a center point 102*a*. Track path 100*b* corresponds to roller assembly 30*b*, has a radius of curvature of 152.082 inches and a center point 102*b*. Track path 100*c* corresponds to roller assembly 30*c*, has a radius of curvature of 140.173 inches and a center point 102c. Track path 100d corresponds to roller assembly 30d, has a radius of curvature of 119.299 inches and a center point 102d. Track path 100e corresponds to roller assembly 30e, has a radius of curvature of 98.387 inches and a center point 102e. Track path 100f corresponds to roller assembly 30f, has a radius of curvature of 78.942 inches and a center point 102f. The track path 13 for the chipper station 14 has a radius of curvature of 57.602 inches and a center point 13g.

Taking the reference point 48 as an origin with the center feed line 34 as an X axis, positive leftward in FIGS. 5A and 5B, and the arbor line 50 as a Y axis, positive downward in FIGS. 5A and 5B, the following grid coordinates further specify the track paths 100 and 13 of the illustrated embodiment:

| | X | Y |
|---|---|---|
| 102a | 177.405 | 0.060 |
| 102b | 153.084 | 0.033 |
| 102c | 140.957 | 0.024 |
| 102d | 119.782 | 0.012 |
| 102e | 98.658 | 0.006 |
| 102f | 79.081 | 0.002 |
| 13g | 57.657 | 0.001 |

It will be understood, however, that the present invention is not limited to a particular travel model configuration. Other configurations are possible while providing the desired track path guidance for the roller assemblies 30 and chipper station 14.

FIG. 5B illustrates the method used to develop the particular travel model of FIG. 5A in providing the track paths 100 for roller assemblies 30 as well as the track path 13 for roller assembly 19 of chipper station 14. In FIG. 5B, an arc 82 is centered on the reference point 48 and at a radius 83 corresponding to the desired position of reference point 32 of a roller 60, or roller 19 in the case of roller assembly 19, on the center feed line 34. A line 84 is taken as tangent to the semicircle 42 at a point of intersection 85 between arc 82 and semicircle 42. A line 86 is taken as tangent to the semicircle 40 at a point of intersection 87 between arc 82 and semicircle 40. Lines 84 and 86 intersect at the point 102, the center point for the track path 100, or track path 13 in the case of roller assembly 19, having a radius of curvature corresponding to the separation between point 102 and point 85.

As may be appreciated, the point 85 lies on semicircle 42 which corresponds to an optimum feed path for a 16 foot cant having a 1 inch chord height. Thus, positional errors for the roller assemblies are essentially zero for a 16 foot cant with 1 inch chord height. This is advantageous where the average cant is 16 feet long with a 1 inch chord height. Such positional errors increase as the distance of roller reference point 32 along path 100 increases from the point 85, and also as the overall distance from reference point 48 increases. Thus, the model may be optimized relative to a given cant length and curvature. Even though so optimized, however, the overall error introduced is acceptable across a reasonable spectrum of cant lengths and curvatures and achieves the desired improved recovery.

By providing a separate actuator for moving each roller assembly 30 along its corresponding track path 100 and for moving chipper station 14 along its track path 13, a single actuator for each roller assembly 30 and one for chipper station 14 could provide the desired positioning of roller assemblies 30 and chipper station 14. The travel model of FIGS. 5A and 5B, however, allows use of even fewer than one actuator for each roller assembly to achieve the desired curved feed path.

Figure 6:
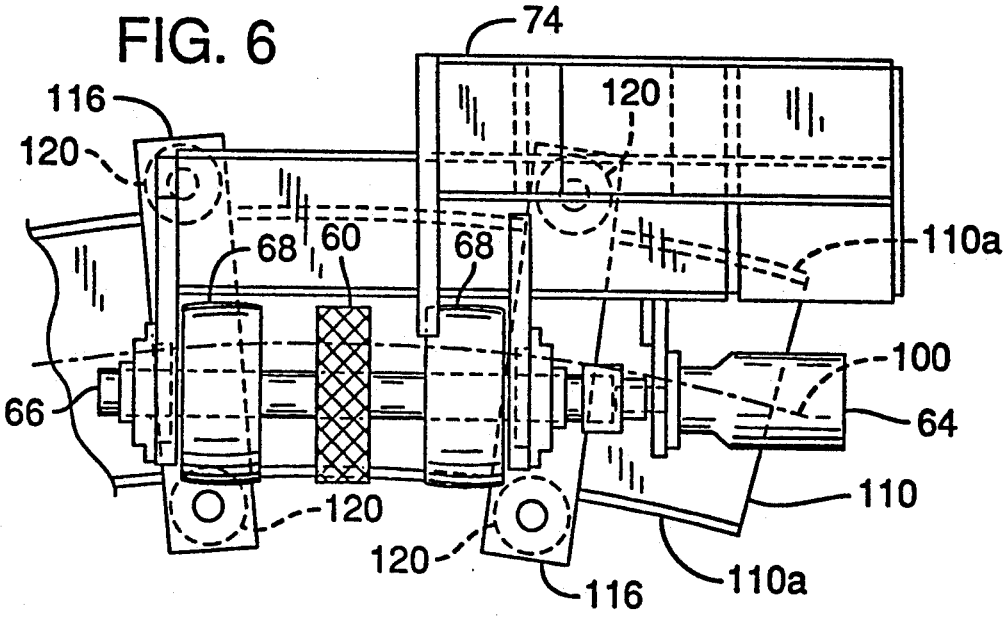
FIG. 6 illustrates a guide mechanism for moving the roller assemblies of FIGS. 1–4 according to the travel model of FIGS. 5A and 5B.
Figure 7:
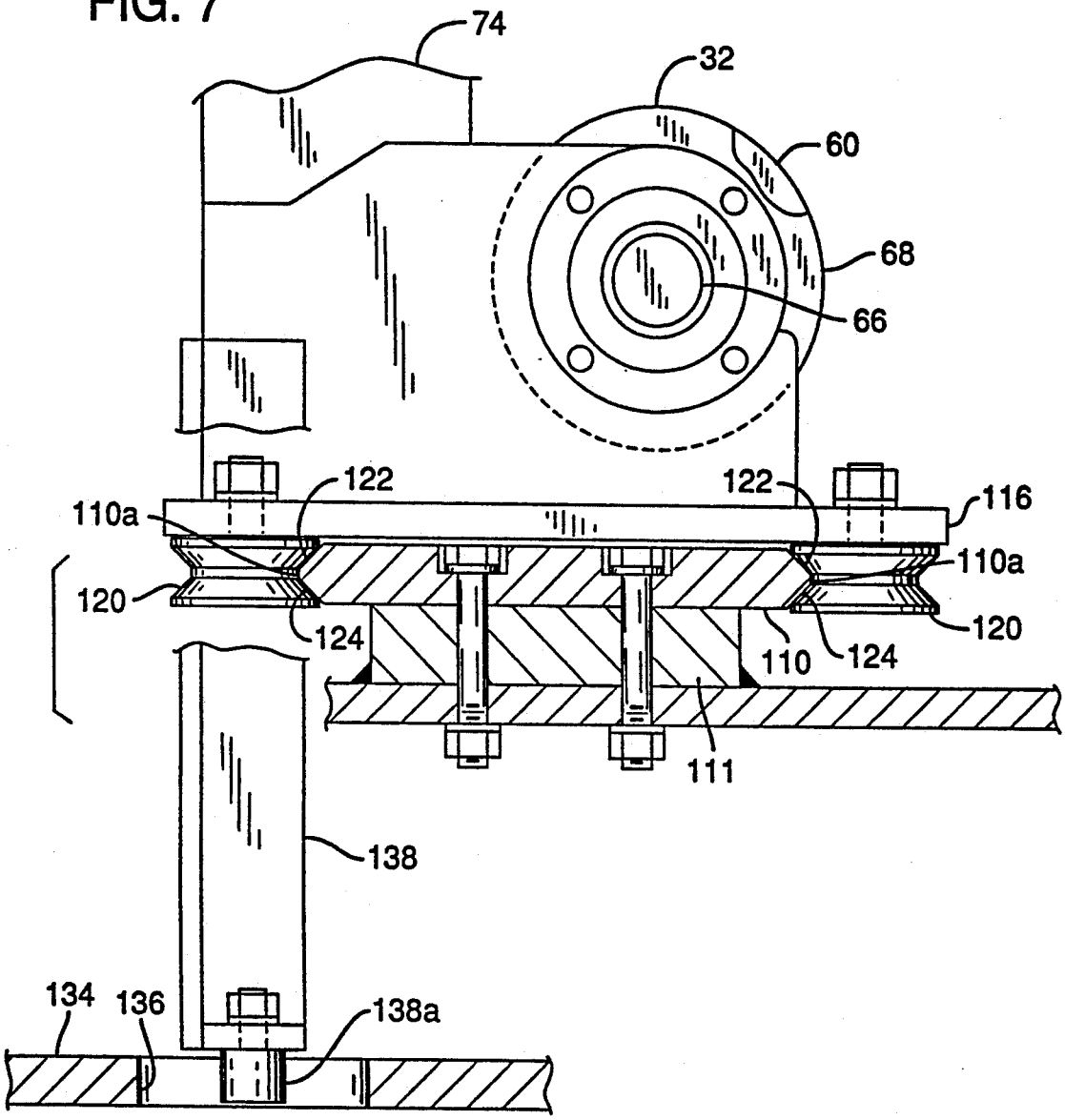
FIG. 7 shows a support mechanism for the roller assemblies of FIGS. 1–4 whereby the roller assemblies may be positioned for movement along the guide mechanism of FIG. 6.

FIGS. 6 and 7 illustrate a guide track 110 such as used for each of the roller assemblies 30 to guide movement of each roller assembly 30 along its corresponding guide track path 100. The guide track 110 is a thick plate supported upon a pedestal 111 and includes outer edges 110a concentric to the corresponding track path 100 (FIG. 6).

The undercarriage 116 (FIG. 7) for each roller assembly 30 carries a set of four rollers 120 adapted for engagement of the outer edges 110a of guide track 110. The outer edges 110a of each guide track 110 define inclined upward and downward facing surfaces 122 and 124, respectively, defining a generally conic cross section thereat. The rollers 120 include inward facing angularly disposed surfaces adapted to engage the surfaces 122 and 124 to suitably support the roller assembly 30 while allowing movement thereof along the guide track path 100. Thus, each of roller assemblies 30a–30f include similar guide tracks 110 for moving the corresponding roller assemblies along their associated track paths 100.

Figure 8:
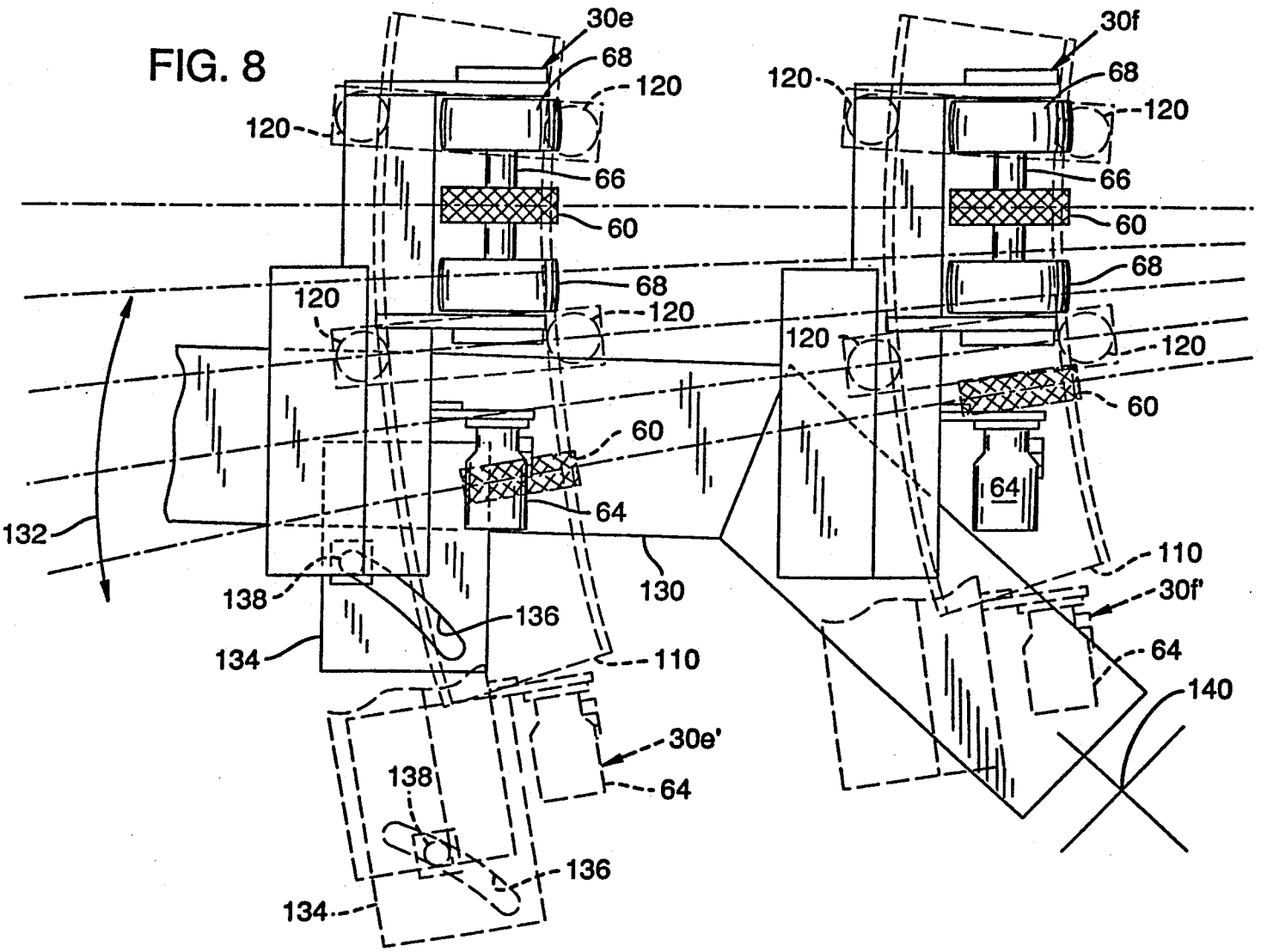
FIG. 8 shows a roller assembly as mounted upon the guide mechanism and engaged for movement along the guide mechanism by means of an actuation member common to substantially all roller assemblies.
Figure 9:
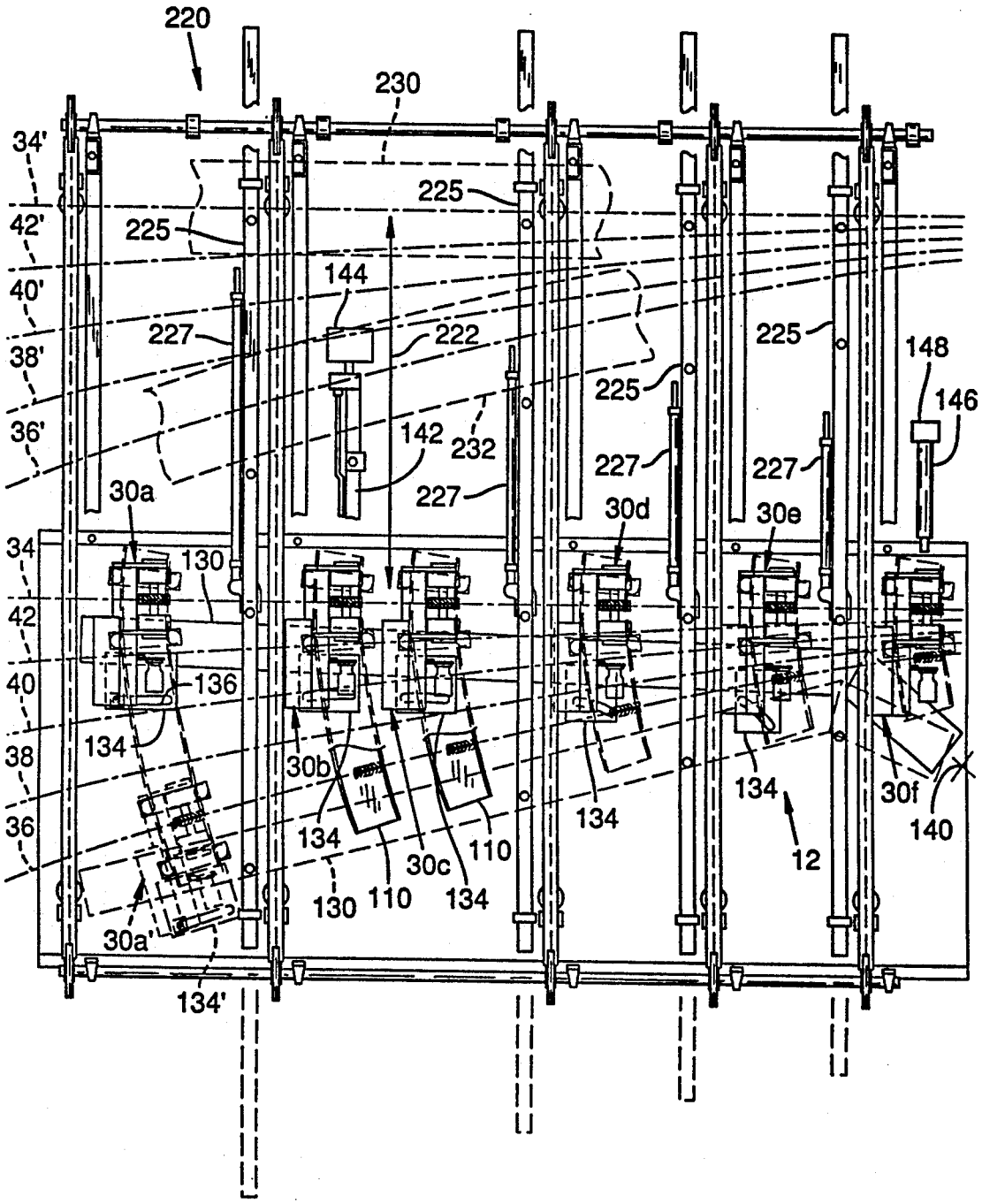
FIG. 9 illustrates movement of the roller assemblies in response to a control element.

FIGS. 8 and 9 illustrate a mechanism for moving the roller assemblies 30 along their corresponding guide track paths 100. FIG. 8 illustrates the actuation mechanism for roller assembly 30e, and is representative of the actuation mechanism for roller assemblies 30a–30d. A separate actuation mechanism is employed for the roller assembly 30f.

In FIG. 8, a pivot bar 130 is adapted for movement in the directions 132. Pivot bar 130 includes plates 134 (see also FIG. 7) each extending horizontally and in the direction of a corresponding one of roller assemblies 30a–30e. The plates 134 include a slot formation 136 and each roller assembly 30 includes a downward extending post 138 resting within the corresponding slot 136. The post 138 includes at its distal end a cam follower bearing 138a (FIG. 7) for reduced friction movement within the slot 138. Thus, movement of pivot bar 130 in the directions 132 engages each roller assembly 30a–30e at the downward extending post 138 for movement along the corresponding guide tracks 110a–110e. With a similar plate 134 and slot 136 provided for each roller assembly 30a–30e along the length of pivot bar 130, a single actuation device may be used for pivoting bar 130 and moving in unison the roller assemblies 30a–30e along the corresponding guide track paths 100a–100e. In FIG. 9, the pivot bar 130 is configured to pivot about the point 140 by means of cylinder 142 coupling a distal portion of pivot bar 130 to a stationary block 144. Each roller assembly 30a–30e couples to the pivot bar 130 by means of its corresponding post 138 engaging the corresponding slot 136 of pivot bar 130.

The location of pivot point 140 and the location and orientation of slots 136 relative to pivot bar 130 are such to allow coordinated movement of roller assemblies 30a–30e. Specifically, by first locating the roller assemblies along center feed line 34 and positioning pivot bar 130 at a given initial position, one end of each slot 136 is located by reference to the corresponding post 138. Thus, positioning of pivot bar 130 at the initial position corresponds to positioning of roller assemblies along center feed line 34. The orientation and shape of each slot 136 is then determined as necessary to properly engage the corresponding post 138 and draw the each roller assembly along its track path 100.

Due to the proximity of roller assembly 30*f* to the pivot point 140, roller assembly 30*f* is independently positioned along its corresponding track path 100*f* by means of hydraulic cylinder 146 coupling roller assembly 30*f* and stationary block 148.

Figure 17:
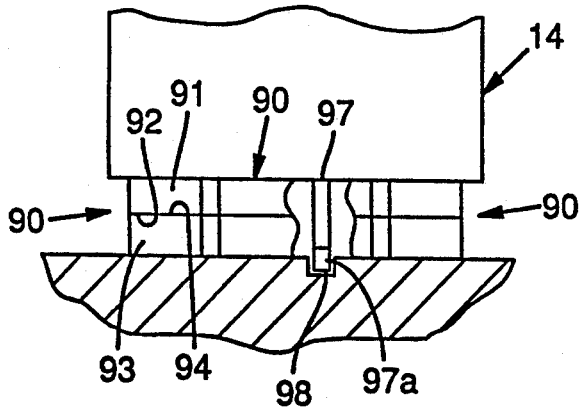
FIGS. 17 and 18 illustrate a mechanism for supporting a chipper station for movement along a semicircular track path.
Figure 18:
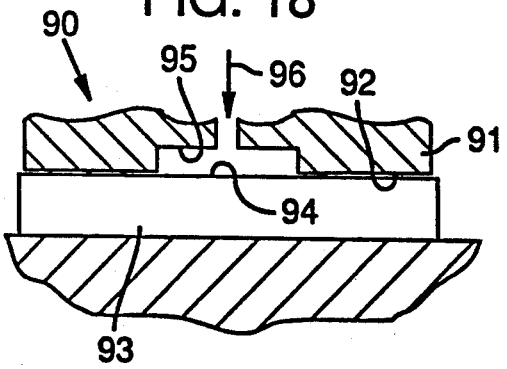

FIGS. 17–18 illustrate a mechanism, similar to that used in the machine tool field, for movement of the chipper station 14 along its track path 13. In FIGS. 17 and 18, the chipper station 14 is supported by a set of pad assemblies 90, each including an upper pad 91 integral to chipper station 14 and providing a downward facing surface 92, and including a stationary lower pad 93 providing an upward facing surface 94. Each upper pad 91 further includes at its surface 92 a reservoir formation 95 (FIG. 18) communicating with a source 96 of pressurized media, e.g. oil. The surfaces 92 and 94 come together in face-to-face relation whereby surface 94 and formation 95 provide a reservoir containing the pressurized media for lifting the chipper station 14 and allowing reduced frictional movement thereof. Chipper station 14 further includes a pair of downward extending posts 97, each carrying at its distal end a cam follower bearing 97*a*, for engagement of stationary slots 98 (see also FIG. 1). Stationary slots 98 are oriented in concentric relation to the track path 13 whereby actuation of cylinder 20 moves the chipper station along its track path 13.

The illustrated travel model and actuation method reduces greatly the number of actuation devices needed and the corresponding control logic to position the roller assemblies 30 and chipper station 14. As previously noted, the positioning of each roller assembly 30 is a function of a single value, a radius of curvature for the selected centerline of the curved cant under process. It may be appreciated that given a single value positioning parameter for the infeed system 12, i.e., the centerline radius of curvature, operation of the associated positioning devices requires relatively simple logic. A second parameter taking into account cant width determines lateral positioning of chipper heads 15 and further shifting of linebar 24. Thus, a radius of curvature value and a width value may be translated into a linear position for each of the positioning devices.

Figure 10:
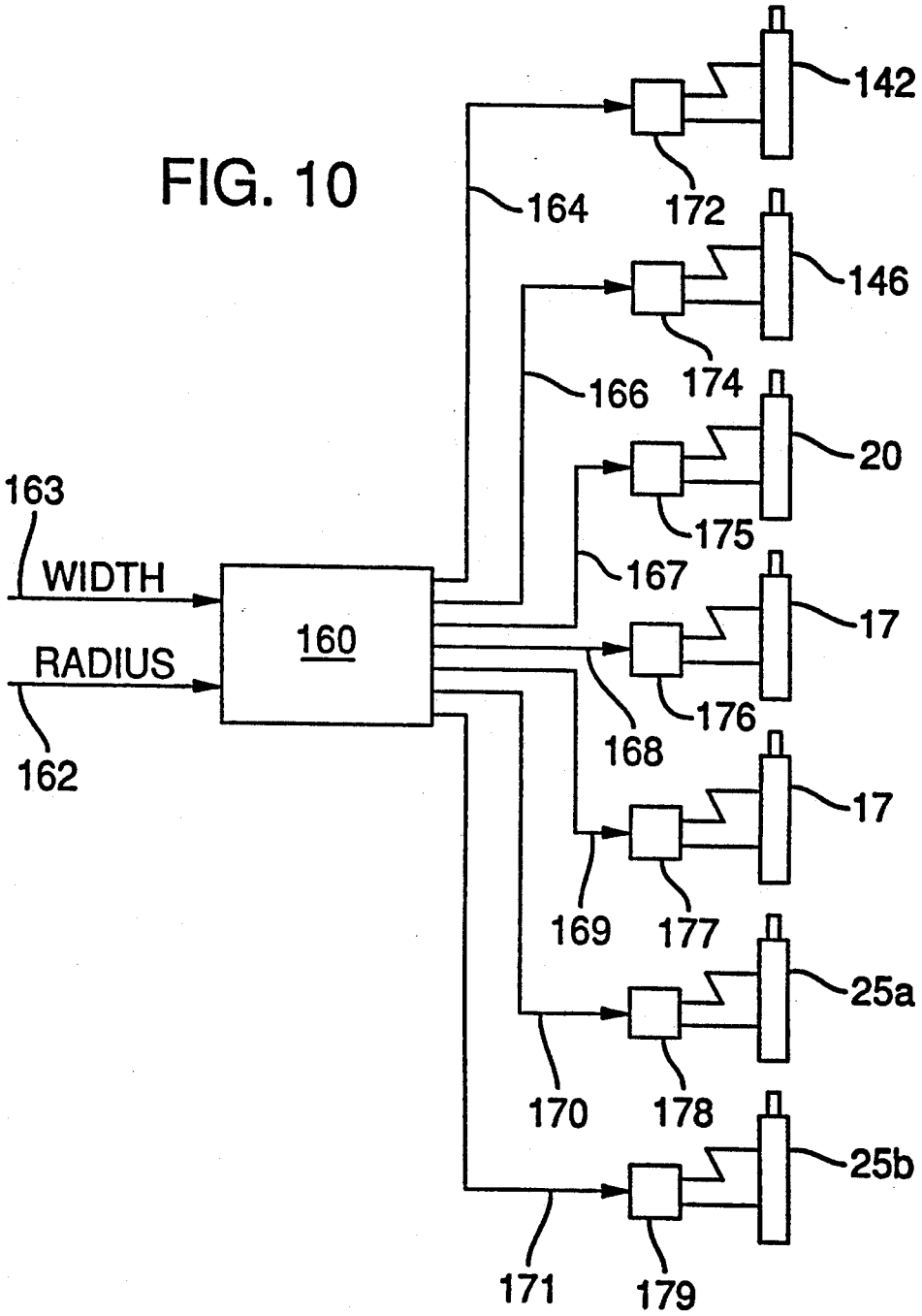
FIG. 10 is a block diagram of control logic adapted for positioning of portions of the around the curve sawing apparatus of FIG. 1 in response to a radius of curvature input.

FIG. 10 illustrates a control 160 receiving input values 162 and 163, i.e., a radius of curvature and a cant width, and producing outputs corresponding to each of the hydraulic cylinders used in positioning of roller assemblies 30, chipper station 14, and linebar 24. Thus, the output 164 is applied to a hydraulic control circuit 172 adapted for actuation of hydraulic cylinder 142. The output 166 applies to a hydraulic control circuit 174 adapted for controlling the positioning of cylinder 146. The output 167 is applied to a hydraulic control circuit 175 for controlling the positioning of hydraulic cylinder 20. The output 168 is applied to a hydraulic control circuit 176 for positioning one of the hydraulic cylinders 17. The output 169 is applied to hydraulic control circuit 177 for positioning of the other cylinder 17. The separate outputs 168 and 169 provide lateral adjustment of chipper heads 15 according to a desired cant width. Also, by making independent the operation of cylinders 17 the resulting four sided cant which emerges from chipper station 14 need not be positioned symmetrically relative to the selected semicircular feed path as would be necessary, for example, when producing an odd number of pieces at the rotary gang 16. The outputs 170 and 171 are applied to hydraulic control circuits 178 and 179 for positioning of the cylinders 25*a* and 25*b*, respectively. The control 160 is suitably configured to receive the inputs 162 and 163 and produce outputs 164–171 in order to position the roller assemblies 30, chipper stationer 14, and linebar 24 according to a selected semicircular path and cant width.

Figure 11:
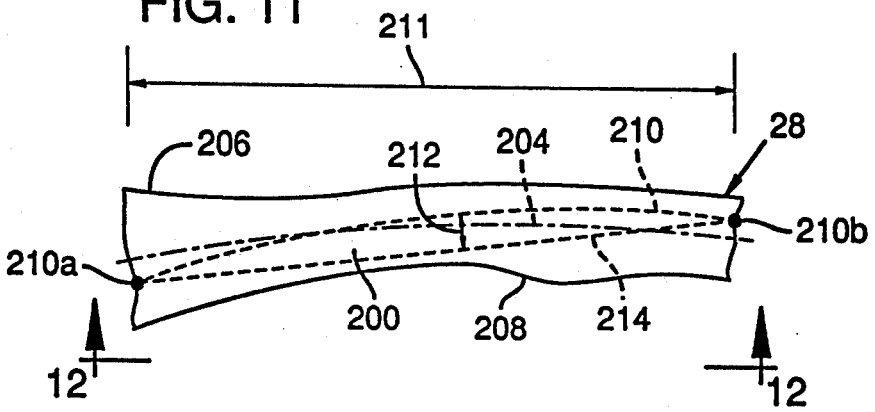
FIGS. 11 and 12 illustrate a curved and irregularly shaped two-sided cant and the selection of a curved centerline therefor in accordance with the present invention.
Figure 12:
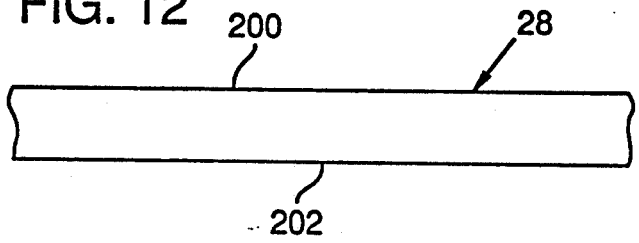

FIG. 11 illustrates a two-sided cant 28 as viewed from above when manipulated by the infeed system 12 of FIG. 1. FIG. 12 illustrates a side view of the two-sided cant 28 as taken along lines 12–12 of FIG. 11. In FIGS. 11 and 12, the two-sided cant 28 includes planar, parallel surfaces 200 and 202. With surface 200 upward facing and surface 202 downward facing, the cant 28 is engaged by each roller assembly 30 at the surface 200 by the pinch roller 62 and at the surface 202 by the drive roller 60 and side idle rollers 68. As shown in FIG. 12, the surfaces 200 and 202 are planar and parallel as provided by conventional breakdown methods wherein a curved log may be positioned "horns up" or "horns down" and transported through a chipper.

In FIG. 11, the cant 28 has a generally irregular, i.e., not well behaved, curvature indicated generally by the curved line 204. The cant 28 includes a swelled a butt 206 and a protrusion 208 representing deviations from the overall curvature as modeled generally by the line 204. A selected curved centerline 210 representing a desired cutting pattern may be identified by a variety of methods. The curved centerline 210 may or may not coincide with a general curvature of the cant 28, i.e., with line 204. The positioning of curved centerline 210 is generally a function of a desired maximization of recovery, either in dollar recovery or specific lumber dimensions, and does not necessarily coincide with the actual curvature of the cant 28. In any event, once the curved centerline 210 is identified, a radius of curvature may be associated with the cant 28 by measurement of the separation 211 between the end points 210*a* and 210*b* of the curved centerline 210 and a maximum deviation 212 from a line 214 connecting the points 210*a* and 210*b*. Thus, the separation 211 together with the deviation 212 defines a unique radius of curvature which may be associated with a selected semicircular feed path for the cant 28. This semicircular feed path, as previously described, when coincident with the reference point 48 of the rotary gang 16 defines positioning of the roller assemblies 30.

Figure 13:
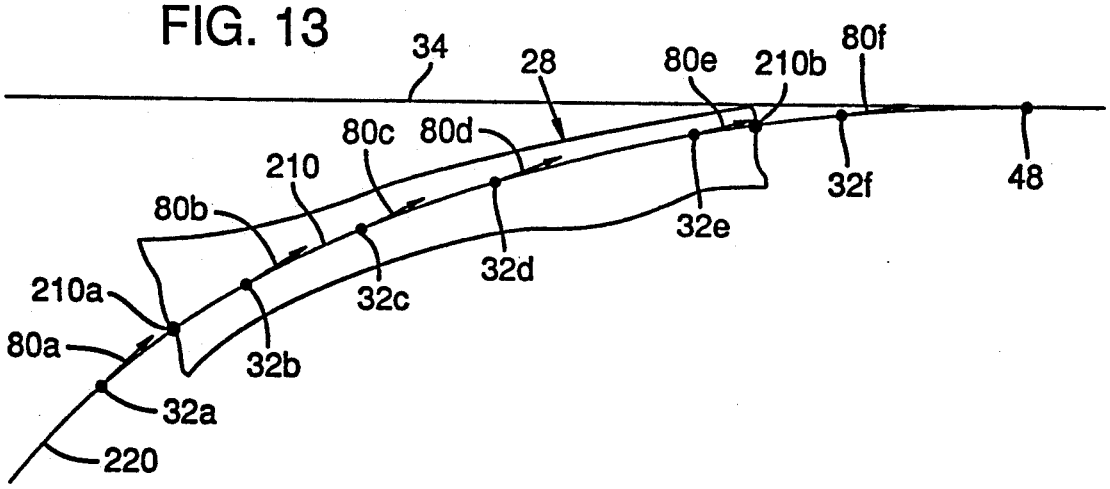
FIG. 13 illustrates mounting of the two-sided cant of FIGS. 11 and 12 by positioning of the selected curved centerline relative to a selected semicircular path as defined by the positioning of the roller assemblies of the infeed system according to the present invention.

FIG. 13 illustrates positioning of the selected curved centerline 210 with respect to a selected semicircular path 220 along which the roller assemblies 30 are positioned. As with all selected semicircular paths of the present invention, the selected semicircular path 220 illustrated in FIG. 13 coincides with the fixed reference point 48 of rotary gang 16 (FIG. 1). Further, the center line 34 is tangent to the selected path 220 at the fixed reference point 48. In positioning the roller assemblies 30*a*–30*f*, each corresponding transport path 80*a*–80*f* is positioned substantially tangent to the selected semicircular path 220 by positioning of the reference points 32*a*–32*f* of roller assemblies 30*a*–30*f* substantially along the selected semicircular path 220 as in accordance with the travel model of FIGS. 5A and 5B.

Thus in order to obtain the desired curved feed path of the cant 28, the centerline 210 is positioned coincident to the selected semicircular path 220, or at least concentric thereto, and the roller assemblies 30 and chipper station 14 are positioned along the selected semicircular path 220 by suitable actuation of cylinders 20, 142 and 146. The pinch rollers 62 are then lowered to engage the cant 28. Upon actuation of the roller assemblies 30a–30f the cant 28 moves along the selected semicircular path 220 and into the rotary gang 16 whereby lines of cut concentric to the centerline 210 are made according to the relative positioning of blades 18 and the cant 28 is severed into corresponding lumber products.

Figure 14:
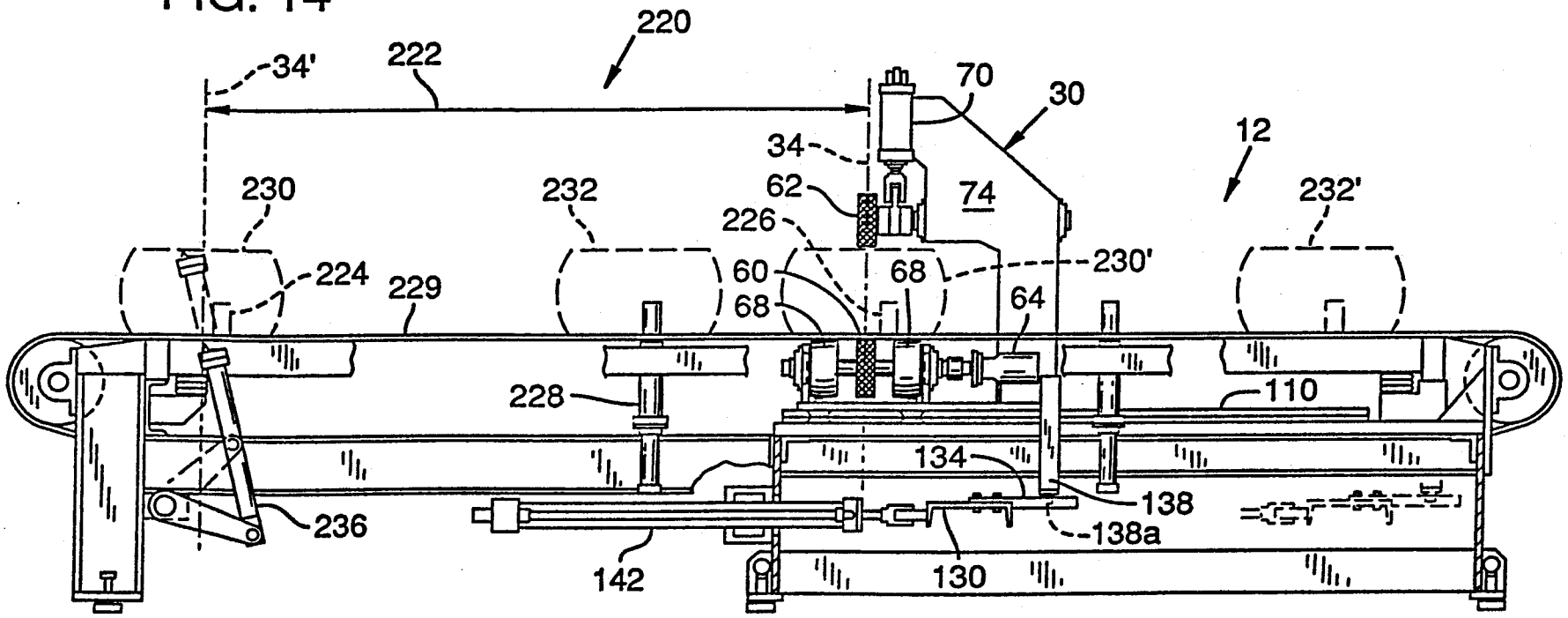
FIG. 14 is a cross-sectional view of a prepositioning table utilized in conjunction with the feed system of FIG. 1.

With reference to FIGS. 9 and 14, a prepositioning table 220 is provided laterally adjacent to the infeed system 12. The prepositioning table 220 includes an offset center feed line 34' at a fixed offset 222 relative to that of center feed line 34. Also shown in FIG. 9 are reference semicircular paths 36', 38', 40' and 42', each offset by the same offset 222 relative to the corresponding semicircles 36, 38, 40 and 42. The prepositioning table 220 allows an operator to position a cant on the prepositioning table 220 along an offset selected semicircular path relative to the offset center feed line 34' and then move the cant laterally by the fixed offset 222 into the infeed system 12. The cant is thereby properly aligned relative to a selected semicircular path for feeding into the gang 16. It will, therefore, be appreciated that given means for manipulation of a cant on the prepositioning table 220 and means for lateral shifting of the cant by the offset 222, an operator may preposition a cant while a preceding cant is being fed into the rotary gang by means of infeed system 12.

Prepositioning on the table 220 is accomplished by a set of preposition pins 224 and a corresponding set of positioning pins 226. Corresponding members of pin sets 224 and 226 are maintained in fixed spaced relation by the offset 222 by mounting of corresponding pins 224 and 226 on the same connecting tube 225. Positioning of tubes 225 is then accomplished by actuation of corresponding hydraulic cylinders 227. Each of the pins 224 and 226 is vertically positionable by means of corresponding pneumatic cylinder 228. A chain 229 supports the cant and urges the cant against the prepositioning pins 224 in the direction of infeed system 12. Thus, by first positioning a cant, as held against the prepositioning pins 224, with reference to the offset center line 34' and along a selected offset semicircular path, and then dropping the prepositioning pins 224, the cant travels along chain 229 until it reaches the upraised positioning pins 226. The cant thereby moves into a desired position relative to a selected semicircular path at the infeed system 12. The roller assemblies 30 and chipper station 14 are also moved relative to the same selected semicircular path of infeed system 12 for engaging and feeding the cant as described above.

Prepositioning table 220 is further provided with a set of flippers 236 for turning a cant to align its curvature on the prepositioning table 220 such that the concave edge of the cant is exposed to the infeed system 12, i.e., horns against the pins 224.

Shown in FIGS. 9 and 14 are two cants 230 and 232. The cant 230 is a straight cant, i.e. having no curvature, and positioned on the prepositioning table 220 in alignment with the offset center feed line 34'. The cant 232 is a curved cant aligned relative to the offset semicircular path 36, It may be appreciated that for any given cant curvature the operator may preposition the cant according to a selected offset semicircular path by use of the pins 224 and chain 229. The ends of cants 230 and 232 are also shown, in FIG. 14, in their position following shifting by offset 222 into the injeef system 12, the offset position being indicated by the references numerals 230' and 232'.

Thus, the prepositioning table 220 provides a means for positioning a cant in offset relation to a desired semicircular path.

Figure 15:
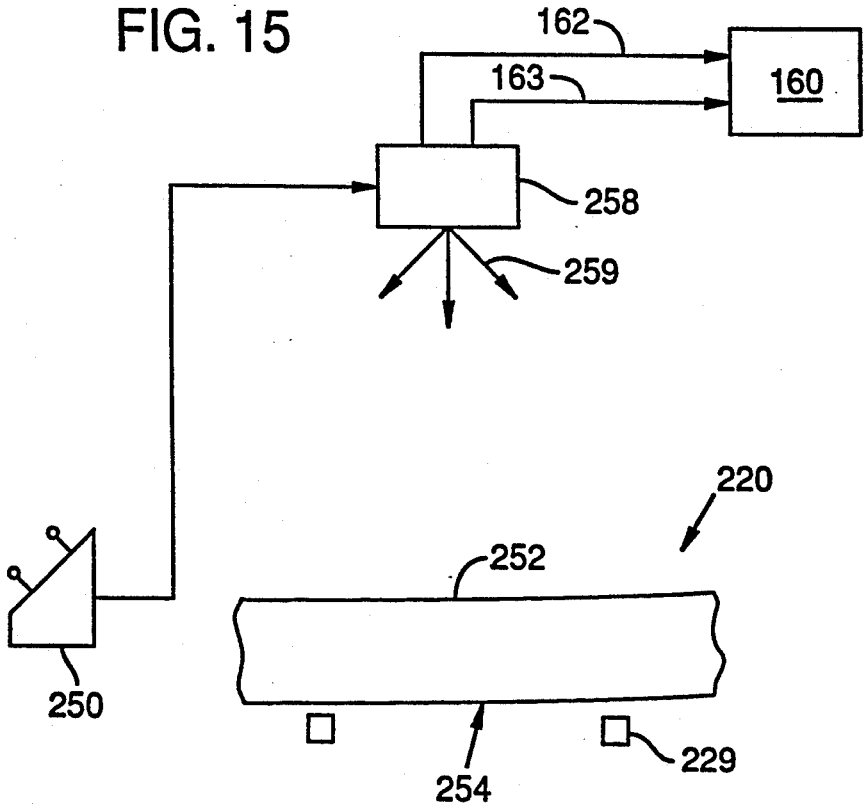
FIGS. 15 and 16 illustrate use of a curved guideline device for positioning a cant at the prepositioning table of FIG. 14.
Figure 16:
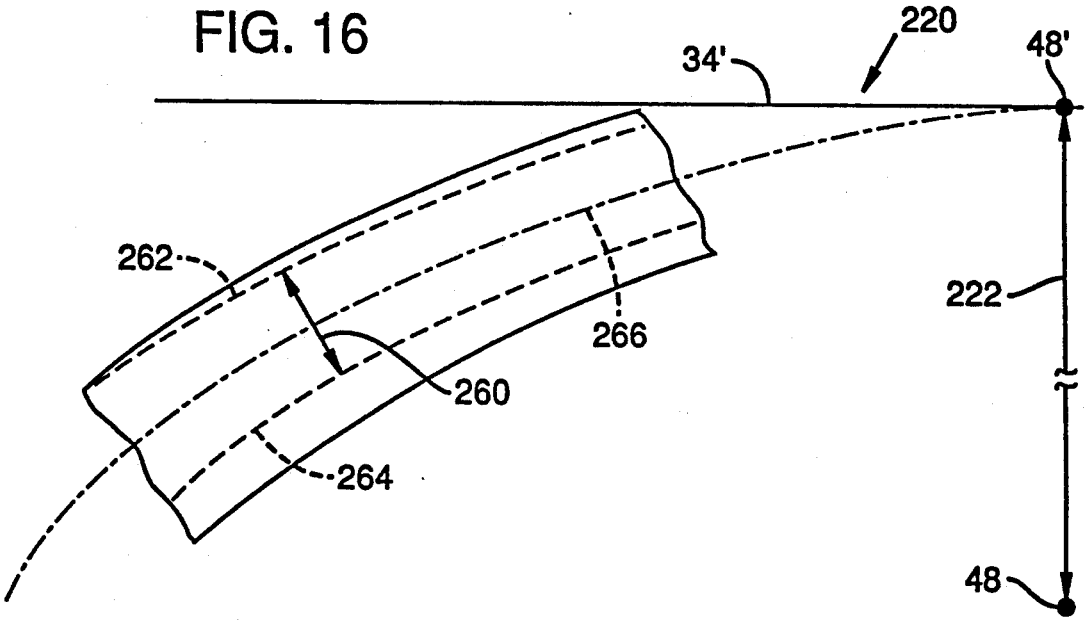

FIGS. 15 and 16 illustrate a mechanism for aiding the operator in alignment of a cant relative to a selected offset semicircular path. In FIGS. 15 and 16, an operator is provided with a control panel 250 and a view of the upper surface 252 of a cant 254 to be prepositioned. Above the prepositioning table 220 is a curved guideline device 258 adapted for emitting guide light 259 to provide two concentric semicircular guide lines 262 and 264 (FIG. 16). The guideline device 258 may, for example, be a pair of programmable galvanometers of the type commercially available for displaying selected light patterns under programmed control. Control panel 250 allows for adjusting a separation 260 between the concentric guidelines 262 and 264 and the radius of a concentric mid-line 266 located half way between the guidelines 262 and 264, but not necessarily displayed by the device 258. Mid-line 266 represents a selected centerline for the cant positioned relative to the offset center feedline 34'. The curved guideline device 258 maintains the mid-line 266 such as to have tangency relative to the offset center feed line 34' at the offset reference point 48'. The offset reference point 48' is also offset from the reference point 48 by the offset 222. Thus, by displaying the guidelines 262 and 264 and manipulating the cant 254 on table 220, a curved centerline for the cant 254 is established by manipulation of the separation 260 between guidelines 262 and 264 and the radius of curvature for the mid-line 266.

The control system would allow the operator to move the guidelines 262 and 264 in continuous fashion until the operator accepts a given radius of curvature, separation between guidelines 262 and 264, and position of the cant relative to guidelines 262 and 264. Upon such operator acceptance, however, the system can determine, with reference to the current settings for gang 16, where the closest cut can be actually made. At this time the guidelines 262 and 264 can under system control automatically snap to represent that cut. The operator then has the opportunity to override this setting. In certain situations, typically where an odd number of pieces are to be cut, it is necessary to mount the cant in offset fashion upon the roller assemblies, i.e. position the curved centerline for the cant concentric to rather than coincident with the selected semicircular path. In this manner one accommodates the center blade 18a relative to the necessary lines of cut. Also in such situation, it is necessary to coordinate the lateral positioning of the chipper heads 15, and linebar 24 in order to properly receive the offset mounted cant, i.e. the chipper heads 15 will be different distances from the selected semicircular path.

The operator thereby coordinates positioning the cant 254 on the prepositioning table 220 whereby the cant may be then delivered against the positioning pins 226 in alignment with a selected semicircular path along which the cant 254 is to be fed into the gang 16. The operator need only use two of the prepositioning pins 224 to accomplish prepositioning of the cant. Selection among prepositioning pins 224 is a function of cant length. While the operator could manually select which of pins 224 are to be used, such selection can be accomplished by known methods, e.g. as with length detecting limit switches (not shown). An experienced operator will develop skill at recognizing the length, width and curvature of cants as they enter the prepositioning table 20. These estimates may be input as the cant moves onto table 220. As may be appreciated, the selection of a radius of curvature determines significantly where the curved guidelines 262 and 264 will appear on the prepositioning table. The experienced operator will then be able to quickly move the cant to that region of table 220 and execute the necessary prepositioning steps.

Once the operator has established the positioning of the cant 254 on the prepositioning table 220 by coordinating the position of the cant 254 relative to the guidelines 262 and 264 as presented by the device 258, the required parameters, i.e., a radius of curvature and cant width, are established for positioning of the roller assembly 30, chipper station 14, and linebar 24. Thus, the curved guideline device 258 provides as its output the required data 162 as the centerline radius of curvature and data 163 as the cant width. Control 160 receives the data 162 and 163 from device 258 for suitable positioning of the roller assemblies, chipper station, and linebar 24 as described above in connection with FIG. 10.

Figure 19:
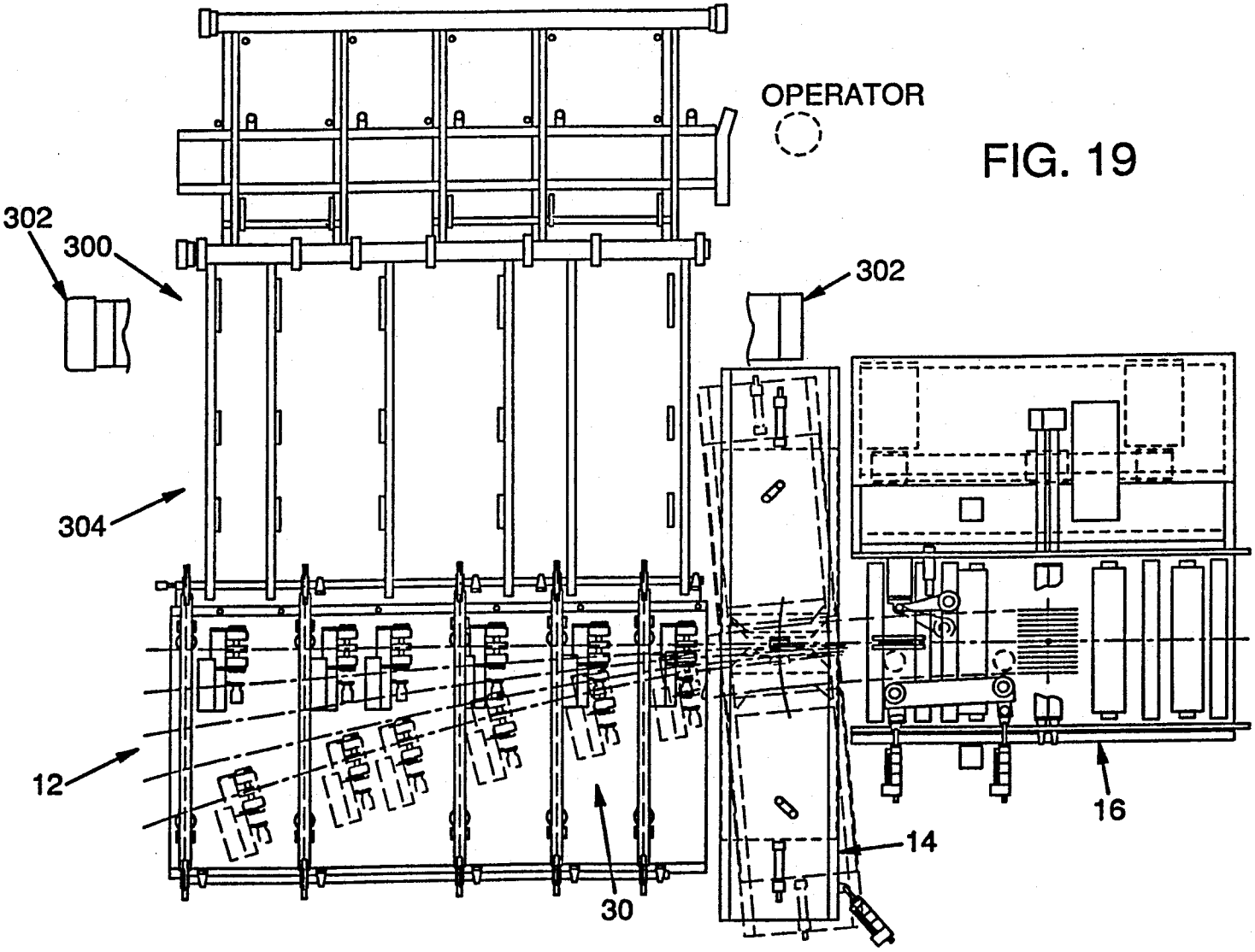
FIGS. 19 and 20 illustrate a more fully automated around the curve sawing system using the feeding and cutting arrangement of FIG. 1 in conjunction with a scanning device for modeling cant characteristics, selecting a curved centerline, and determining cant mounting upon the roller assemblies.
Figure 20:
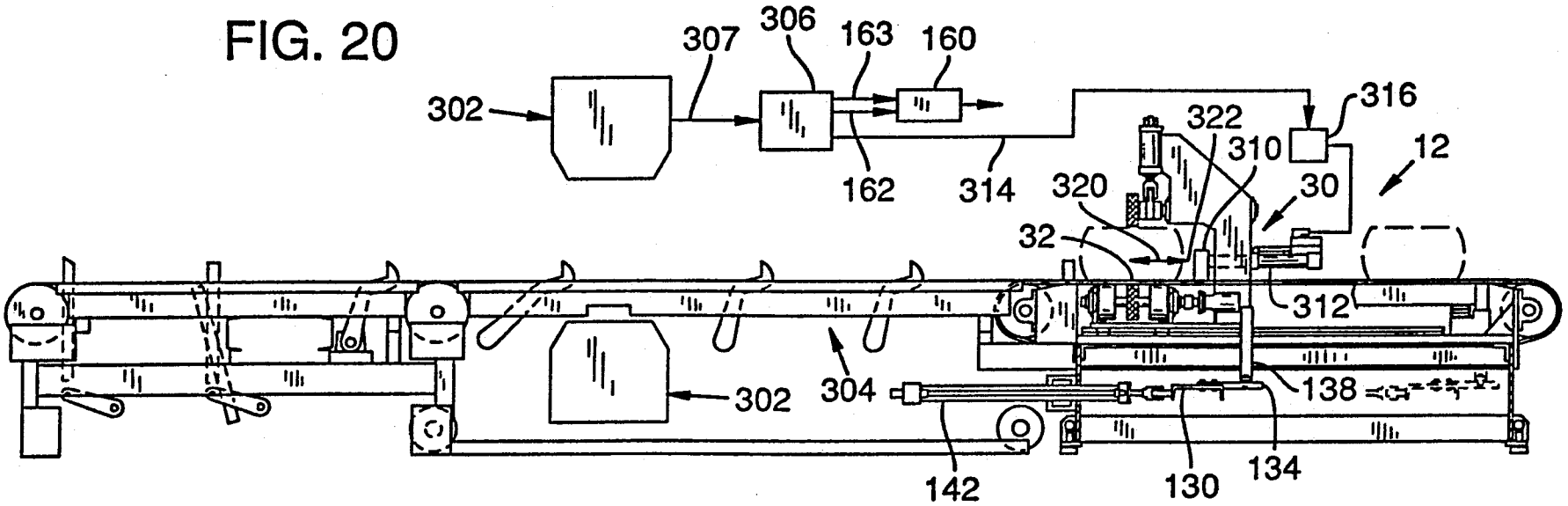

FIGS. 19 and 20 illustrate a more fully automated around the curve sawing system using the feeding and cutting arrangement of FIG. 1 in conjunction with a scanning device for modeling cant characteristics, selecting a curved centerline, and determining cant mounting upon the roller assemblies. In FIGS. 19 and 20, a rotary gang 16, chipper station 14, and roller assemblies 30 are provided as described above. A scanning table 300 is provided as the input to the infeed system 12 whereby an operator feeds cants one at a time through a scanning arrangement 302. The scanning arrangement 302 develops a model of each cant including length, width, curvature, and selection of a curved centerline for establishing a desired around the curve cutting pattern. A queuing table 304 hold cants just prior to mounting upon the roller assemblies 30.

A control 306 receiving scan data 307 from the scanning arrangement 302 uses the model for each cant on the queuing table 304. Based on the computer model of the cant next ready for mounting on roller assemblies 30, a radius of curvature 162 and a cant width 163 are delivered to the control 160 as previously described in order to position the roller assemblies 30 and 19, chipper heads 15, and the linebar 24 according to a selected semicircular path corresponding to the selected curved centerline and according to the width of the cant.

Each of roller assemblies 30 is further provided with a horizontally disposed mounting pin 310 carried at the distal end of an hydraulic cylinder 312. The control 306 provides mounting offset data 314 to hydraulic control circuits 316, one for each roller assembly 30, in order to position each pin 310 suitably to receive the leading edge 322 of the cant to be mounted upon roller assemblies 30. More particularly, given a model of the cant, the control 306 takes into account the cant width and selected curved centerline in order to determine for each roller assembly an offset 320 between the selected curved centerline and the corresponding portion of the leading edge 322 of the cant. Given an offset 320 for each roller assembly 30, the corresponding pins 310 may be positioned relative to the roller reference point 32 by the associated offset 320 whereby the cant is suitably mounted upon the roller assemblies, typically with the selected curved centerline coincident to the selected curved feed path, but offset mounting may be provided as necessary. It may be appreciated that only two of the positioning pins 310 need be used to properly orient the cant relative to the roller assemblies 30.

Figure 21:
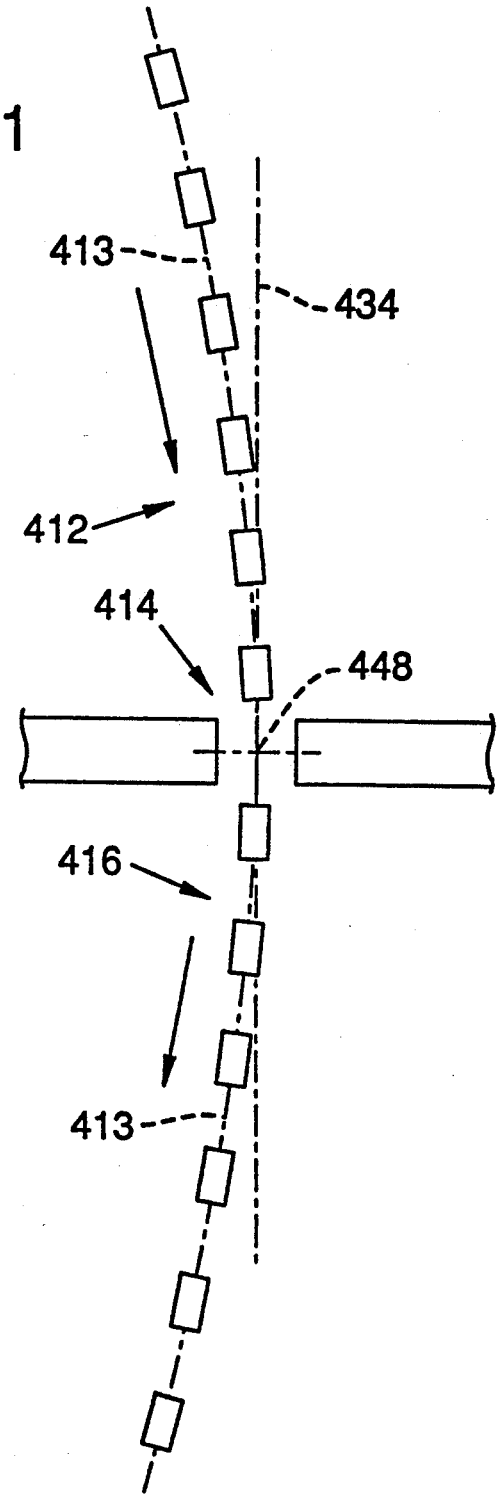
FIG. 21 illustrates an around the curve infeed and outfeed for a twin band saw arrangement.

With reference to FIG. 21, the method of curved feeding provided by the infeed system 12 described above may also be applied at the outfeed portion of an around the curve sawing arrangement. In FIG. 21 an infeed system 412, illustrated schematically but similar to system 12 described above, provides around the curve feeding along a selected semicircular path 413 tangent to a center feed line 434 at a fixed reference point 448 within a twin band saw 414. As may be appreciated from the above description, an outfeed system 416 may be provided at the output of twin band saw 414 to continue the selected feed path 413. The structure and operation of the outfeed system 416 would essentially be a mirror image of the infeed system and it will be understood that such adaptation is well within the ordinary skill persons in this field.

Figure 22:
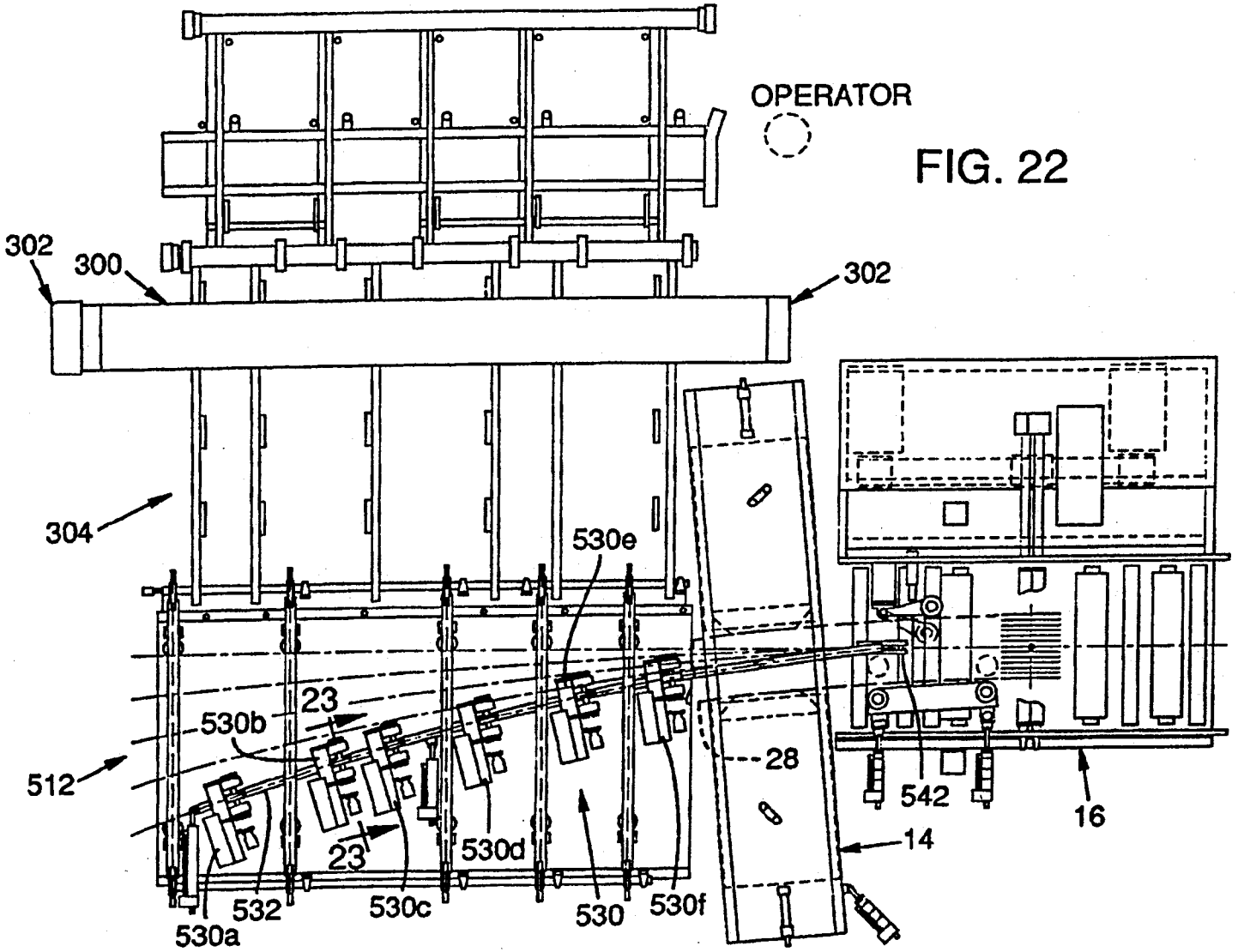
FIGS. 22–25 illustrate an alternative in-feed table for providing a curved feed path into a cutting device.

FIGS. 22–25 illustrate an alternative method moving a cant 28 along a selected curved feed path. In FIG. 22, the illustrated system is similar to that of FIG. 19 but is modified by provision of the in-feed table 512. The in-feed table 512 includes a set of feed assemblies 530, individually 530*a*–530*f*, corresponding to the roller assemblies 30 described above. The feed assemblies 530 are similar in basic structure and positioning to that of the roller assemblies 30, but do not include a lower drive roller. Thus, each feed assembly 530 is carried on a curved guide track 100 (not shown) and the set of feed assemblies 530 may be positioned along a selected curved feed path as described herein above. In place of the drive rollers, the table 512 employs a common drive chain 532 which passes directly below each press roller 62. The feed chain 532 must necessarily conform to this curved feed line. The feed chain 532 is, therefore, adapted to bend laterally to conform to a selected curved feed line. A drive chain suitable for this purpose, i.e., able to conform to a selected curved feed line, is available under the product name SIDE FLEX CHAIN and product number SM120 from Rexnord, Inc.

Figure 23:
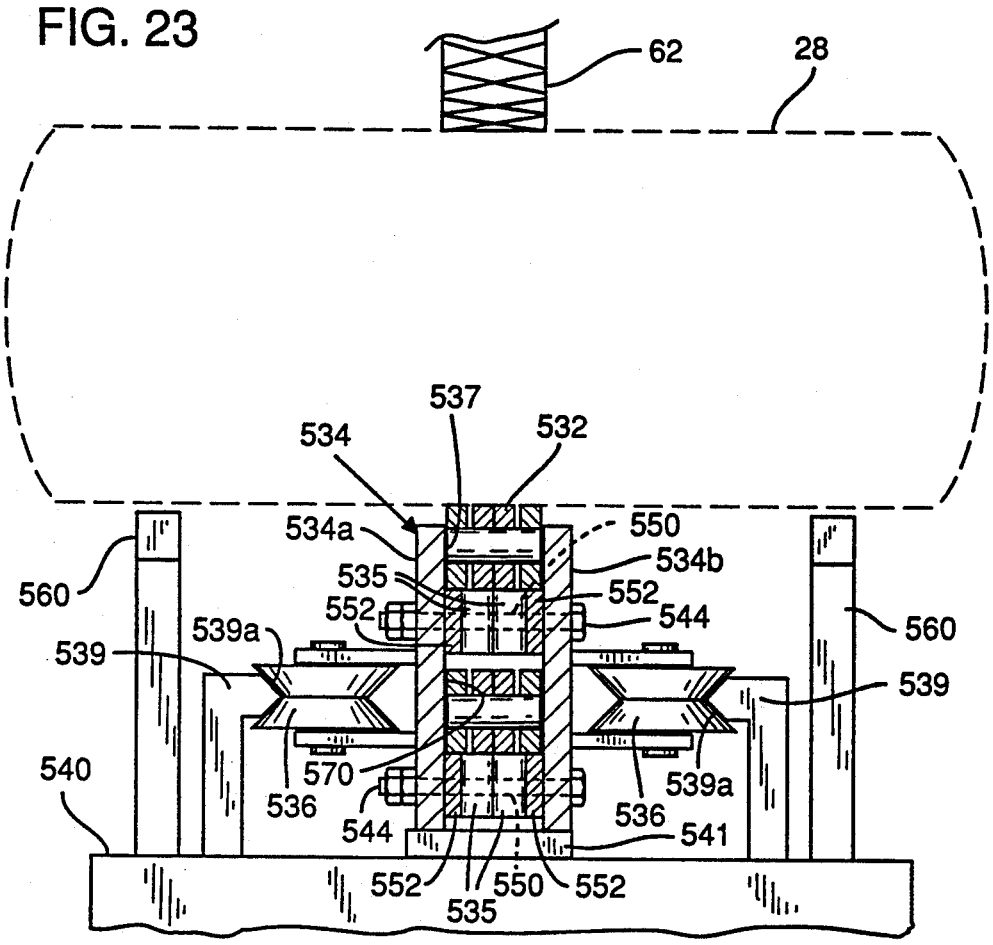
Figure 24:
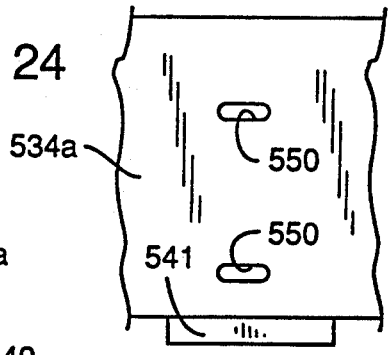
Figure 25:
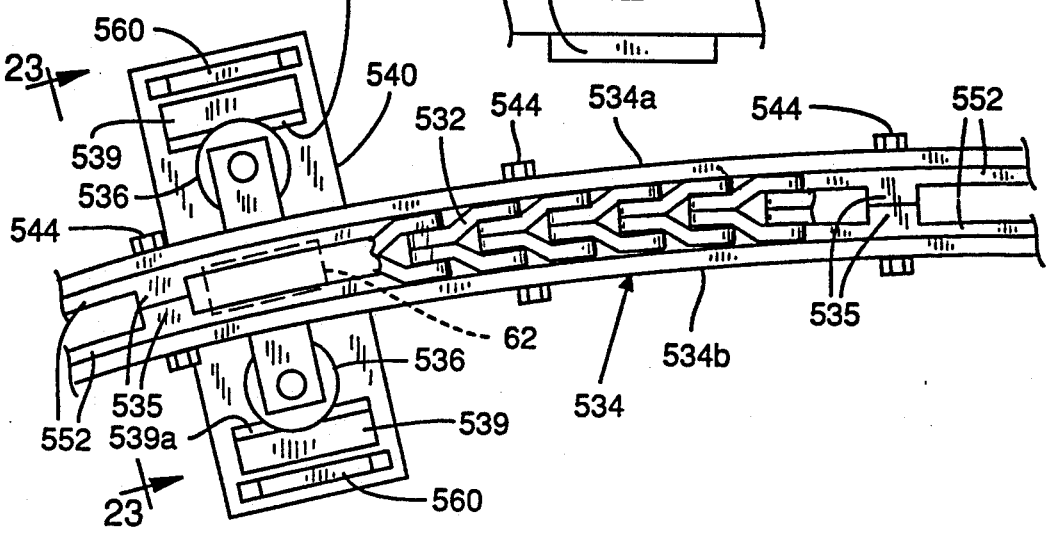

With further reference to FIGS. 23–25 in conjunction with FIG. 22, the feed chain 532 is supported by a laterally flexible support track 534. The support track 534 generally assumes a channel-like configuration in receiving chain 532, but may be coerced into a selected curvature. The support track 534 includes a left portion 534*a* and a right portion 534*b* positioned relative to one another by abutting inward extending spacers 535 to define a channel-like formation 537 for slidably supporting and guiding the drive chain 532. Guide track 534 includes a pair of laterally outward extending side rollers 536 in the vicinity of each assembly 530. Each roller 536 rotates about a vertical axis. Guide plates 539 are held against the rollers 536 of the support track 534 immediately below the corresponding press roller 62. More particularly, a pair of such guide plates 539 are affixed to a support platform 540 of each assembly 530 directly below the corresponding press roller 62. Each guide plate 539 includes an inwardly directed guide edge 539*a* engaging the corresponding roller 536. The rollers 536 define a concave V-shaped configuration matching a convex V-shaped configuration of the edges 539*a* of plates 539. Lateral and vertical movement of the guide track 534 relative to press roller 62 is thereby restricted while allowing some longitudinal movement of the guide track 534. The guide track 534 rests slidably upon the support platform 540, e.g., as by a plastic lowfriction plate 541. The guide track 534 is then captured directly below the corresponding press roller 62, i.e., a line tangent to the curved support track 534 thereat is perpendicular to the axis of rotation for the corresponding press roller 62. In this manner, positioning of the assemblies 530 along a selected curved feed path coerces the track 534 into corresponding curvature directly below each press roller 62.

The guide track 534 is held together by pairs of vertically aligned bolts 544. Each bolt 544 passes through the portion 534*a* and 534*b* and through the corresponding spacers 535. The spacers 535 should be secured, e.g., as by welding, to the corresponding portions 534*a* and 534*b*. Furthermore, the spacers 535 which mount fixedly to the portion 534*b* of guide track 534 provide a cylindric aperture closely receiving the bolt 544. The apertures of portion 534*a* and the corresponding spacers 535, however, should be provided as slots 550 (FIG. 24) to accommodate the curved configuration of the guide track 534 while maintaining the desired spaced relationship between the portions 534*a* and 534*b*.

Each portion 534*a* and 534*b* carries on its inner surface a shelf 552 (FIG. 25) along the length of guide track 534 for slidably supporting the chain 532 thereon. Because the guide track 534 must be coerced into a curved configuration, it is important that the thickness of the portions 534*a* and 534*b* be minimized to allow such curved configuration. In this regard, the shelf 552 of each portion 534*a* and 534*b* should only be of sufficient width to adequately support the chain 532 therein.

Thus, the support platform 540 and guide plates 539 generally replace the drive roller 60 of the previously described roller assemblies 30. The addition of the drive chain 532 and curvable support track 534 completes the in-feed table 512. In other respects, the positioning of the drive assembly 530 may be accomplished in a manner as described above in connection with the positioning of drive assemblies 30.

Returning to FIG. 22, a drive sprocket 542 positioned at the input end of the gang 16 engages the chain 532 to pull the chain 532 along the guide track 534. A tensioned idler gear 543 is carried on the feed assembly 530, i.e., most distant from gang 16. A return path for the chain 532 from the idler gear 543 to the drive gear 542 may be provided by the lower tub-like portion 570 (FIG. 23) of track 534 and additional shelves 532 to complete the movement path for chain 532.

Thus, in the embodiment of FIGS. 22–25, the cant 28 is supported for feeding when captured between the press roller 26 and the chain 532 therebelow. Furthermore, the platform 540 may be provided with a pair of stabilizing plates 560 on either side of the guide plates 539 in order to avoid tipping of the cant 28. In this regard, the height of the plates 560 should be slightly less than that of the chain 532 to allow the chain 532 to receive the full weight of the cant 28. The chain 532 may be provided with surface formations, e.g., could be scored, to better frictionally engage the undersurface of cant 16 to drive the cant 16 along a selected curved feed path.

Thus, an improved around the curve sawing method and apparatus have been shown and described. The method and apparatus of the present invention transports curved wood product along a selected semicircular path which may be coordinated with a selected curved centerline of the wood product in order to transport the wood product through a cutting apparatus for cutting substantially concentric to the curved centerline of the wood product. In accordance with the illustrated preferred embodiment, the mechanism includes a common actuation member for reducing significantly the number of actuators needed for proper positioning of the roller assemblies according to a travel model. It will be appreciated, however, that the present invention is not restricted to the particular embodiment or embodiments that have been described and illustrated herein, and that variations may be made therein without departing from the scope of the invention as found in the appended claims and equivalence thereof.

What is claimed is:

1. A method for processing a curved wood article having first and second open faces in spaced and substantially parallel relation, the curvature of the wood article being substantially within a given plane parallel to said first and second open faces, the method comprising:

supporting said wood article at least one of said first and second open faces and applying feed force to said wood article at at least one of said first and second open faces in such manner to move the wood article along a selected curved path into a cutting device; and cutting the wood article along a curved line corresponding to said curved path.

2. A method according to claim 1 wherein said curved line is one of concentric to and coincident with said curved path.

3. A method according to claim 1 wherein said step of applying feed force comprises the step of applying a plurality of individual feed forces to said wood article, each of said feed forces being substantially tangent to said curved path.

4. A method according to claim 1 wherein said step of supporting said wood article and applying feed forces comprises the step of applying feed forces at a point coincident to a point of support at one of said first and second open faces.

5. A device for cutting a curved wood article, the device comprising:

a cutting device positioned at a fixed point;

a plurality of feed assemblies each supporting the wood article in such manner that upon application of a feed force to said wood article the wood article moves along a selected curved feed path by coordinated positioning of said feed assemblies; and a feed assembly positioning arrangement coordinating positioning of said feed assemblies to select said curved feed path as corresponding to the curvature of said wood article and coinciding with said fixed point.

6. A device according to claim 5 wherein at least one of said feed assemblies applies a feed force to said wood article at a point coincident with a point of support thereof.

7. A device according to claim 6 wherein at least one of said feed assemblies comprises a roller assembly, the roller assembly comprising opposing parallel rollers engaging the wood article therebetween with at least one of the opposing rollers being a drive roller for applying a feed force tangential to said selected curved feed path.

8. A device according to claim 5 wherein said device further comprises a feed force application device comprising a curved element movable into curved configuration corresponding to said selected curved feed path and then movable along said curved feed path for wood article feeding in coordination with said feed assemblies.

9. A device according to claim 5 wherein each of said feed assemblies is positionable in selection of said curved path by movement along a corresponding curved guide track.

10. A device according to claim 9 wherein said curved guide track is a semicircular guide track providing rectilinear movement of the corresponding feed assembly in at least two dimensions and further provides rotation of the corresponding feed assembly about an axis normal to said at least two dimensions.

11. A device according to claim 5 wherein said feed assembly positioning arrangement comprises a positioning bar pivotable at one end and coupled along its length to said feed assemblies whereby pivoting of said bar accomplishes positioning of said feed assembly along a selected curved path.

12. A device for cutting a curved wood article, the device comprising:

a cutting device;

a plurality of feed assemblies each supporting the wood article in such manner that upon application of a feed force to said wood article the wood article moves along a selected curved feed path by coordinated positioning of said feed assemblies; and a feed assembly positioning arrangement coordinating positioning of said feed assemblies to select said curved feed path as corresponding to the curvature of said wood article, said positioning arrangement providing both rotational and rectilinear positioning of said feed assemblies to select said curved feed path.

13. A device according to claim 12 wherein each of said feed assemblies delivers a corresponding feed force to said wood article at a point coincident with a point of support provided thereby.

14. A device according to claim 13 wherein each feed force is substantially tangential to said selected curved feed path.

15. A method for processing a curved wood article having first and second open faces in spaced and substantially parallel relation, the curvature of the wood article being substantially within a given plane parallel to said first and second open faces, the method comprising:

supporting said wood article at said first and second open faces and applying feed force to said wood article in such manner to move the wood article along a curved path into a cutting device; and cutting the wood article along a curved line corresponding to said curved path while maintaining said cutting device fixed at a point tangent to a curve concentric to said curved path.

16. A method for processing a curved wood article having first and second open faces in spaced and substantially parallel relation, the curvature of the wood article being substantially within a given plane parallel to said first and second open faces, the method comprising:

supporting said wood article at said first and second open faces and applying feed force to said wood article in such manner to move the wood article along a curved path into a cutting device;

identifying a curved model relative to the body of said wood article and corresponding to the curvature of said wood article; and selecting said curved path as a function of said curved model.

17. A method according to claim 16 wherein said curved feed path is one of concentric to and coincident with said curve model.

18. A method for processing a curved wood article having first and second open faces in spaced and substantially parallel relation, the curvature of the wood article being substantially within a given plane parallel to said first and second open faces, the method comprising:

supporting said wood article at said first and second open faces and applying feed force to said wood article in such manner to move the wood article along a curved path into a cutting device, said step of applying feed force comprising the step of applying a plurality of individual feed forces to said wood article, each of said feed forces being substantially tangent to said curved path, said step of applying feed forces comprising the step of capturing said wood article with a plurality of roller assemblies, each roller assembly comprising an upper roller and a lower roller engaging said first and second open faces, respectively, with the axes of rotation for each of the rollers being positioned transverse to said selected curved path.

19. A method for processing a curved wood article having first and second open faces in spaced and substantially parallel relation, the curvature of the wood article being substantially within a given plane parallel to said first and second open faces, the method comprising:

supporting said wood article at said first and second open faces and applying feed force to said wood article in such manner to move the wood article along a curved path into a cutting device, said step of applying feed force comprising the step of engaging said wood article with a feed mechanism having a curvature corresponding to said selected curved path and the step of moving said feed mechanism along said curved path; and cutting the wood article along a curved line corresponding to said curved path.

20. A method according to claim 19 wherein said step of applying feed force comprises the step of forcing a laterally bendable drive chain relative to said selected curved feed path and supporting one of said first and second open faces upon said drive chain.

* * * * *